US009975372B2

(12) United States Patent
White et al.

(10) Patent No.: US 9,975,372 B2
(45) Date of Patent: May 22, 2018

(54) MULTI-DIMENSIONAL ART WORKS AND METHODS

(71) Applicants: Charles White, Houston, TX (US); Louise Nicholson Carter, Houston, TX (US); Kirk Bauer, Spring, TX (US)

(72) Inventors: Charles White, Houston, TX (US); Louise Nicholson Carter, Houston, TX (US); Kirk Bauer, Spring, TX (US)

( * ) Notice: Subject to any disclaimer, the term of this patent is extended or adjusted under 35 U.S.C. 154(b) by 0 days. days.

(21) Appl. No.: 15/188,869

(22) Filed: Jun. 21, 2016

(65) Prior Publication Data

US 2017/0361642 A1 Dec. 21, 2017

(51) Int. Cl.
*B44C 1/22* (2006.01)
*C23F 1/20* (2006.01)

(52) U.S. Cl.
CPC ..... *B44C 1/227* (2013.01); *B44C 1/222* (2013.01); *C23F 1/20* (2013.01)

(58) Field of Classification Search
None
See application file for complete search history.

(56) References Cited

U.S. PATENT DOCUMENTS 3,092,523 A 6/1963 Fromson
3,622,471 A 11/1971 Izumikawa
3,632,486 A 1/1972 Herrmann et al.
3,833,374 A * 9/1974 Patrick ..... G03F 7/00 106/31.06
3,839,163 A 10/1974 Kaneda et al.
3,841,891 A 10/1974 Pallant
3,874,949 A 4/1975 Kaneda et al.
3,955,980 A * 5/1976 Lange ..... B01D 45/12 216/12
4,101,386 A 7/1978 Dotzer et al.
4,144,142 A 3/1979 Takahashi et al.
4,149,912 A 4/1979 Craighead et al.
4,210,695 A 7/1980 Hirono et al.
4,578,318 A 3/1986 Schoch et al.
4,670,084 A 6/1987 Durand
4,869,789 A 9/1989 Kurze et al.
5,624,261 A 4/1997 Wiedenfeld
5,857,709 A 1/1999 Chock
5,968,636 A 10/1999 Sinclair et al.
5,985,416 A 11/1999 Sherman et al.
6,277,544 B1 8/2001 Singh et al.
6,342,145 B1 * 1/2002 Houssian ..... C25D 11/12 205/122

(Continued)

FOREIGN PATENT DOCUMENTS

GB 2478641 A 9/2011
JP S5047832 4/1975

(Continued)

*Primary Examiner* — Shamim Ahmed
(74) *Attorney, Agent, or Firm* — Cesari & Reed LLP; R. Michael Reed

(57) ABSTRACT

In some embodiments, a method may include selectively applying a mask to a first surface of a substrate. The mask may include one or more components defining a selected pattern and having a non-uniform density. The method may further include etching the first surface of the substrate based on the mask and selectively processing the first surface of the substrate to produce a multi-dimensional artwork.

17 Claims, 24 Drawing Sheets

(56) References Cited

U.S. PATENT DOCUMENTS

| | | | | |
|---|---|---|---|---|
| 6,468,439 | B1 * | 10/2002 | Whitehurst | C23F 1/02 216/100 |
| 6,609,459 | B1 * | 8/2003 | Figov | B41C 1/05 101/150 |
| 6,849,308 | B1 | 2/2005 | Speakman et al. | |
| 6,896,787 | B2 | 5/2005 | Yan | |
| 7,291,370 | B2 | 11/2007 | Gipson et al. | |
| 7,476,792 | B1 | 1/2009 | Musser | |
| 7,891,095 | B2 | 2/2011 | Jonsson et al. | |
| 7,934,848 | B1 | 5/2011 | Pever et al. | |
| 8,061,618 | B2 | 11/2011 | Mosteller | |
| 8,220,142 | B2 | 7/2012 | Lim | |
| 8,451,598 | B2 | 5/2013 | Goh et al. | |
| 8,493,727 | B2 | 7/2013 | Knopf et al. | |
| 2002/0153253 | A1 * | 10/2002 | Nishino | B41N 3/034 205/50 |
| 2003/0065401 | A1 * | 4/2003 | Amrich | A61B 17/8085 623/23.55 |
| 2004/0258906 | A1 | 12/2004 | Scaramuzzino | |
| 2005/0138974 | A1 | 6/2005 | Ha et al. | |
| 2005/0155162 | A1 | 7/2005 | Schacht et al. | |
| 2005/0197617 | A1 | 9/2005 | Gorham et al. | |
| 2006/0051592 | A1 | 3/2006 | Rawlings et al. | |
| 2007/0041611 | A1 | 2/2007 | Hersch et al. | |
| 2007/0179429 | A1 | 8/2007 | Gorham et al. | |
| 2008/0196985 | A1 | 8/2008 | Meckel | |
| 2008/0248405 | A1 * | 10/2008 | Almanza-Workman | H01L 21/0272 430/5 |
| 2009/0048557 | A1 | 2/2009 | Yeshurun et al. | |
| 2009/0130600 | A1 * | 5/2009 | Irving | G03F 7/2022 430/312 |
| 2009/0181214 | A1 | 7/2009 | Yang | |
| 2010/0317469 | A1 | 12/2010 | Comello et al. | |
| 2011/0304972 | A1 | 12/2011 | Goh et al. | |
| 2012/0106067 | A1 | 5/2012 | Goh et al. | |
| 2012/0118686 | A1 | 5/2012 | Meckel | |
| 2012/0171807 | A1 | 7/2012 | Berger et al. | |
| 2013/0071559 | A1 | 3/2013 | Zhu et al. | |
| 2013/0137210 | A1 * | 5/2013 | Cheng | H01L 31/022425 438/98 |
| 2013/0176091 | A1 | 7/2013 | Lancaster-larocque et al. | |
| 2013/0232829 | A1 | 9/2013 | Voiles | |
| 2014/0112112 | A1 | 4/2014 | Plankert et al. | |
| 2014/0166098 | A1 * | 6/2014 | Kian | C23C 18/54 136/256 |
| 2014/0216300 | A1 | 8/2014 | Wu et al. | |
| 2014/0300436 | A1 | 10/2014 | Lancaster-larocque et al. | |
| 2014/0349031 | A1 * | 11/2014 | Nakamura | B05D 5/00 427/558 |
| 2015/0218398 | A1 * | 8/2015 | Loccufier | C09D 11/101 347/102 |
| 2015/0225890 | A1 | 8/2015 | Caronico et al. | |
| 2016/0153094 | A1 * | 6/2016 | Tuteja | C23F 1/16 216/53 |

FOREIGN PATENT DOCUMENTS

| | | |
|---|---|---|
| JP | H05338187 | 12/1993 |
| JP | H10330994 | 12/1998 |
| JP | 11-236697 | 8/1999 |
| JP | 2005051105 | 2/2005 |
| JP | 2006204991 | 8/2006 |
| TW | 201238065 | 9/2012 |

* cited by examiner

1800

1802

1820

1900

2000

2100

2200

2300

MULTI-DIMENSIONAL ART WORKS AND METHODS

FIELD

The present disclosure is generally related to multi-dimensional art works, systems and methods, and more particularly to produce works of art that include multi-dimensional features.

BACKGROUND

Works of visual art, such as paintings, sculptures, photographs, and the like, may be produced by various artists, such as painters, sculptors, photographers, and so on. Increasingly, some works of visual art can be produced using electronic devices, including printers, digital displays, and even three-dimensional printers.

SUMMARY

Embodiments of methods, systems, and apparatus are described below that utilize properties of different components, such as different pigment compositions, combinations of inks, and non-uniform ink densities to produce a mask that can be applied as a pattern to a first surface of a substrate. The substrate may then be exposed to an etching solution or process to produce an etched substrate, and the etched substrate may be further processed, such as by machine polishing, applying ink, applying ultraviolet light, applying thermographic plastic, applying heat, applying protective layers (e.g., clear coats, laminates, other coatings, etc.), or any combination thereof to produce a multi-dimensional work of art.

In some embodiments, a method may include selectively applying a mask to a first surface of a substrate. The mask may include one or more components defining a selected pattern and having a non-uniform density. The method may further include etching the first surface of the substrate based on the mask and selectively processing the first surface of the substrate to produce a multi-dimensional artwork.

In other embodiments, a multi-dimensional artwork may include a substrate including a first surface having one or more etched portions. The one or more etched portions can include etches of different depths and thicknesses. The multi-dimensional art work may further include an ink pattern applied to at least a portion of the first surface and a sealant layer applied to at least one of the ink pattern and the substrate. The substrate, the one or more etched portions and the ink pattern may cooperate to provide a multi-dimensional artwork.

In still other embodiments, a method may include selectively applying a mask to a first surface of a substrate. The mask may include at least one of a plurality of pigment components and a non-uniform density. The method may also include selectively exposing the first surface of the substrate to an etching solution and selectively processing the first surface to produce a multi-dimensional workpiece.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

Embodiments of methods, systems, and apparatuses are described below that can produce a mask formed from multiple components and of non-uniform thicknesses, which mask may be applied to a substrate. The substrate may then be exposed to an etching solution or process to produce an etched substrate, and the etched substrate may be further processed, such as by machine polishing, applying ink, applying ultraviolet light, applying a protective coating (e.g., clear coats, laminates, other protective coatings, etc.), applying thermographic plastic, applying heat, or any combination thereof to produce a multi-dimensional work of art.

In some embodiments, the multiple components of mask may include pigments, which may be printed on the substrate in a single printing operation, alone or in combination and with varying component densities. In an example, the mask may have a spatially varying thickness that is formed by varying density of a single pigment in a particular area or by varying the densities of two or more of the pigments of a combination of pigments. Further, the pigment or combination of pigments may be selected to achieve lines, shapes, and textures of selected widths and depths in the etched substrate. Other embodiments are also possible.

Further, in some embodiments, ink may be selectively applied to a substrate, which can be etched, to form a desired pattern. An ultraviolet light used to cure the ink may be selectively applied or at least partially obstructed, leaving the ink uncured or partially cured. Thermoplastic material may be applied to the substrate and over the ink. In some embodiments, the ink and thermoplastic material may be exposed to ultraviolet light to cure the ink and secure the thermoplastic material to the pattern. Excess thermoplastic material (that is, thermoplastic material that is on the substrate but that is not secured by the ink) may be removed, and the substrate may be heated to cause the thermoplastic material to flow. In some embodiments, the substrate may be heated first or in conjunction with exposure to ultraviolet light. Other embodiments are also possible.

Figure 1:
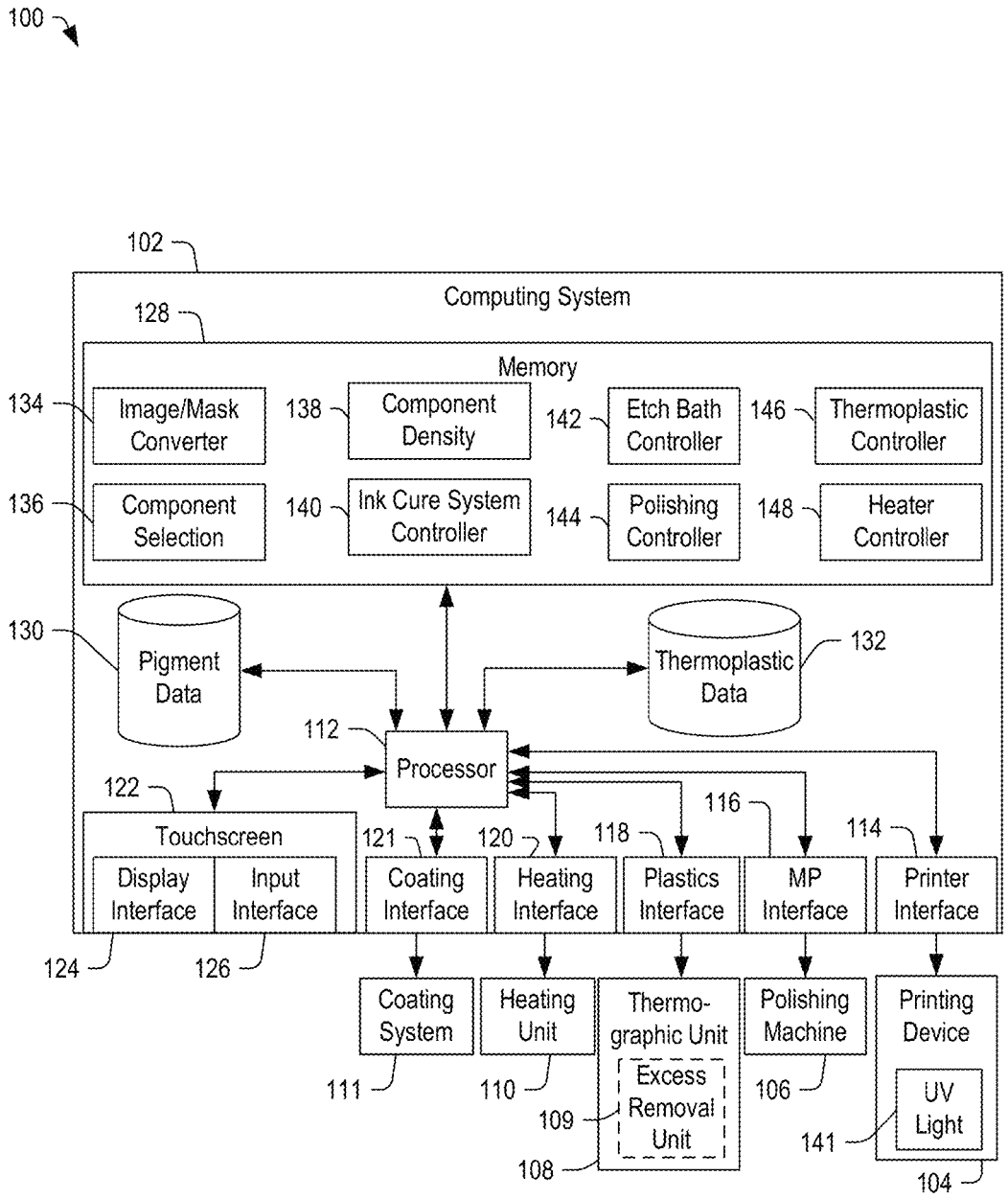
FIG. 1 is a block diagram of a computing system configured to produce multi-dimensional visual art, in accordance with certain embodiments of the present disclosure.

FIG. 1 is a block diagram of a computing system 100 configured to produce multi-dimensional visual art, in accordance with certain embodiments of the present disclosure. The computing system 100 may be configured to communicate with a printing device 104, a polishing machine 106, a plastics printer (thermographic unit) 108, a heating unit 110, and a coating system 111. In some embodiments, the computing system 100 may also be configured to communicate with a display device, to receive input data from one or more input devices (e.g., a keyboard, a stylus, a keypad, a pointer, a computer mouse, a flash drive, another input device, or any combination thereof), and to communicate with one or more remote devices through a network. Other embodiments are also possible.

The computing system 100 may include a processor 112 configured to communicate with the printing device 104 through a printer interface 114, with the polishing machine 106 through a machine polishing (MP) interface 116, with the thermographic unit 108 through a plastics interface 118, with the heating unit 110 through a heating interface 120, and with the coating system 111 through a coating interface 121. In an embodiment, the printing device 104 may include an ultraviolet light configured to cure the ink, and the printing device 104 may also include a blocking mechanism configured to selectively obstruct the ultraviolet light to implement selected printing processes or may include circuitry that can be controlled to selectively disable the ultraviolet light to implement selected printing processes. In some embodiments, the thermographic unit 108 may include an excess removal unit 109, which may be configured to apply a vacuum or to direct air toward the surface to remove and capture excess thermoplastic material.

The computing system 100 may include a touchscreen 122 or other interface(s) coupled to the processor 112 and configured to deliver visual data to a user and to receive selections. The touchscreen 122 may include a display interface 124 and an input interface 126, such as a capacitive or resistive touch-sensitive interface. The computing system 100 may further include a memory 128 coupled to the processor 112 and configured to store data and instructions that can be executed by the processor 112. The processor 112 may also be coupled to pigment data 130 and to thermoplastic data 132, which may be store in memory 128, may be stored in one or more other memories, or may be accessed through a network connection.

The memory 128 may include an image/mask converter 134 that, when executed, may cause the processor 112 to receive an image, to process the image to identify a plurality of characteristics, and to translate the image to a selected output size. In some instances, the image may be translated into a plurality of image portions, which may be printed onto a corresponding plurality of substrates that may be aligned like puzzle pieces to assemble the image. Further, the image/mask converter 134 may cause the processor 112 to convert the characteristics into image elements in terms of line widths, etch depths, and other characteristics of the image, which may be translated onto a substrate, such as a metal substrate.

The memory 128 may include a component selection module 136 that, when executed, may cause the processor 112 to identify one or more components from a plurality of components, which may be applied to a substrate independently from one another or in selected combinations and in non-uniform densities to produce a mask that can be used to produce each of the lines, depths, and shapes identified by the image/mask converter 134.

In some embodiments, the components may include pigment compositions. In some embodiments, particular pigments or combinations of pigments may have different masking properties with respect to preventing an etching bath from etching the surface of the substrate. In some embodiments, the adhesion between a particular pigment component and the surface may differ from that of another pigment component (of the same pigment but different chemical composition) applied to the same substrate. Further, in some embodiments, particular pigments may adhere better than others, and particular combinations of pigments may also interact with the surface differently from other combinations. Additionally, the component (pigment) density may impact the mask coverage as well as the etching effect on the substrate. The image/mask converter 134 may be configured to determine components of the mask that may be used to produce an etch pattern on a surface of the substrate.

Further, the memory 128 can include a component density selection module 138 that, when executed, may cause the processor 112 to determine a component density for each of the selected components or combination of components. The memory 128 may also include an ink cure system controller 140 that, when executed, may cause the processor 112 to selectively control the ultraviolet (UV) light 141 or a blocking mechanism associated with the UV light 141 of the printing device 104 to selectively enable and disable a UV curing of the ink.

The memory 128 may also include an etch bath controller 142 that, when executed, may cause the processor 112 to determine a solution concentration and duration for applying an etching solution to at least a first surface of a substrate. The memory 128 may also include a polishing controller 144 that, when executed, may cause the processor 112 to control the polishing machine 106 via the MP interface 116. The memory 128 can also include a thermoplastic controller 146 that, when executed, may cause the processor 112 to control the thermo-graphic unit 108 via the plastics interface 118 to apply thermographic (thermoplastic) material to a substrate and to control the excess removal unit 109 to selectively remove excess thermoplastic material from the substrate. The memory 128 may also include a heater controller 148 that, when executed, may cause the processor 112 to control the heating unit 110 via the heating interface 120.

In an embodiment, the computing system 100 may receive an image to be produced on one or more substrates. The computing system 100 may automatically analyze the image to determine a plurality of characteristics in the image (e.g., colors, shapes, contrasts, etc.) and to translate the characteristics to dimensions that fit the one or more substrates. The computing system 100 may further determine components for producing a mask, which may be printed on the substrate to control the etching of the substrate to reproduce the image.

In some embodiments, the mask may be applied as a multi-component (or multi-pigment) mask, where the computing system 100 can determine the mask thickness (density) and the composition of the mask (i.e., a single pigment composition or a combination of two or more pigment compositions). By varying the mask composition (individual components (pigments) and combinations of components (pigments)) and by providing a non-uniform density (i.e., spatially varying pigment density across the printed mask), the computing system 100 may be configured to apply a mask to a substrate that, when exposed to an etching solution, may protect selected portions of the substrate from etching to varying degrees. In an example, a low density (e.g., 5-20% coverage) of any of the pigment colors may result in at least a partial etching in the printed area that differs from the more uniform etching in areas that are not covered by the mask. Such etching may be attributable to incomplete coverage of the mask due to the process by which printers apply ink to a surface. Further, higher density application of one or more pigments may increasingly inhibit etching until 100% density of any of the inks may prevent etching in covered areas for certain line thicknesses and for a selected period of time depending on the cure time and the pigment composition.

In some embodiments, pigment compositions may bond to the substrate better than other pigment compositions, impacting not only the density of the ink needed to produce a particular line or shape but also the line weight that can be formed using the particular pigment composition. For finer lines, such as lines having a pixel width of five pixels, it may be desirable to apply multiple pigments, to adjust (increase) the pigment density of one or more of the pigments, and so on. For line weights that are thicker, it may be possible to produce the line using relatively less ink. Further, the line thickness and the ink density may also be influenced by the particular pigment composition (which may be supplier dependent), the solution concentration, the type of material that the substrate is formed from, and the duration of the etching bath operation. The computing system 100 may be configured to determine one or more components and corresponding one or more component densities of such components to achieve a selected line thickness. The component density may be different from pixel to pixel and between components at a selected pixel location.

In some embodiments, the computing system 100 may automate the component selections, component density selections, solution concentration, and etch bath duration, and may provide instructions to the touchscreen interface 122 to assist an operator. Further, in some embodiments, the computing system 100 may automate certain aspects, such as controlling the printing device 104 to advance the substrate beneath the printing head and to control the printing head to apply the selected pigment or pigments and to control the pigment density or densities. Further, in some embodiments, a robotic component may be configured to pick and place a substrate in the printer 104, then to remove the substrate from the printer 104 and deliver the substrate to a curing station to allow the ink time to cure. In some embodiments, the robotic component may deliver the substrate to an etching solution, remove and wash the substrate, and deliver the substrate to the printer 104, to the polishing machine 106, to the thermo-graphic unit 108, to the heating unit 110, to the coating system 111, or any combination thereof, depending on the desired finish. In such an embodiment, the memory 128 may include a robotics module that may be executed by the processor 112 to control the robotic component, which may be coupled to the computing device 100 through wired or wireless interface or through a network. Other embodiments are also possible.

In an example, an image may be provided to the computing system 102 for reproduction on a substrate. The computing system 102 may process the image to determine image features for etching onto the substrate. Further, the computing system 102 may determine components from a plurality of components and corresponding component densities for producing an etching mask. The computing system 102 may control the printing device 104 to apply the mask to a first surface of the substrate. In an embodiment in which only one side of the substrate is to be etched, the computing system 102 may provide the substrate to the coating system 111 for application of a protective coating on a surface of the substrate that is opposite to that of the mask. In an example, the computing system 102 may control the printing device 104 to apply a mask to a first surface of the substrate and may control the coating system 111 to apply a protective coating a second surface (opposite the first surface) and to edges of the substrate to prevent etching. After curing of the mask and optionally the protective coating, the computing system 102 may cause the substrate to be exposed to an etching bath (such as by controlling a robotic arm or by providing instructions to an operator. After cleaning of the substrate (post etching), the computing system 102 may control at least one of the polishing machine 106, the printing device 104, the thermographic unit 108, the heating unit 109, and the coating system 111 to produce a multi-dimensional art work in accordance with certain embodiments.

To determine the component densities and component selections for use as an etching mask, one or more printer color tests may be performed on a sample of the substrate material. One possible example of such a test is described below with respect to FIGS. 2-7.

Figure 2:
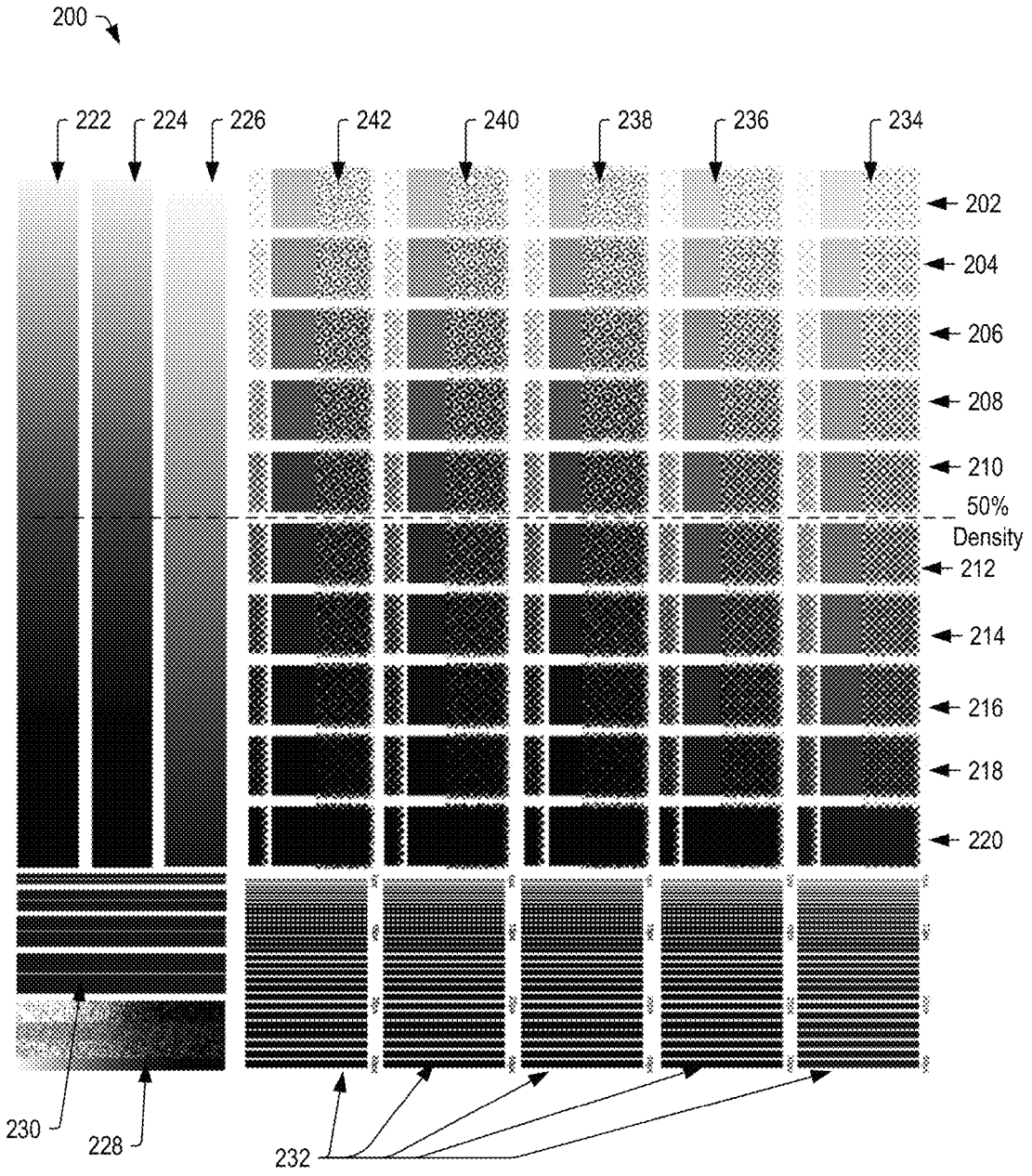
FIG. 2 depicts a multi-component mask, in accordance with certain embodiments of the present disclosure.

FIG. 2 depicts a multi-component mask 200, in accordance with certain embodiments of the present disclosure. The multi-component mask 200 may include a plurality of blocks of pigments, pigment combinations and densities. In the illustrated example, the row 202 depicts blocks having a ten percent (10%) density. Row 204 depicts blocks having a twenty percent (20%) density. Row 206 depicts blocks having a thirty percent (30%) density. Row 208 depicts blocks having a forty percent (40%) density. Row 210 depicts blocks having a fifty percent (50%) density. Row 212 depicts blocks having a sixty percent (60%) density. Row 214 depicts blocks having a seventy percent (70%) density. Row 216 depicts blocks having an eighty percent (80%) density. Row 218 depicts blocks having a ninety percent (90%) density. Row 220 depicts blocks having one hundred percent (100%) density. The blocks 202-220 may utilize a standard printer ink distribution, which may be stochastic, may utilize a uniform or custom distribution of ink using a screen or using custom printer control firmware for a custom pattern of ink distribution, depending on the implementation.

In FIG. 2, columns 234, 236, 238, 240, and 242 represent different pigments and combinations of pigments. Column 234 represents a black pigment. Column 236 represents a combination of black and cyan pigments. Column 238 represents a combination of black, cyan, and magenta pigments. Column 240 represents a combination of black, cyan, magenta, and yellow pigments. Column 242 represents a combination of black, cyan, magenta, yellow, and white pigments. It should be appreciated that the particular pigments and pigment combinations represent just one possible example out of many different possible combinations.

Further, the mask 200 may include a first gradient distribution 222 including black, cyan, magenta, yellow and white; a second gradient distribution 224 including black, cyan, magenta, and yellow; and a third gradient distribution 226 including black only. The mask 200 may also include a plurality of lines 232 of varying thickness ranging from about 30 pixels to approximately 1 pixel in thickness. Finally, the mask 200 may include a gradient 228 formed using a mezzotint pattern and a plurality of inverse lines 230, which may be used to determine how thin of an etch line may be produced.

The mask 200 may be produced using other patterns and other pigment compositions and combinations of pigments. By producing such masks and by experimenting with different ink compositions, different ink combinations, different cure times, different etch solution concentrations, and different etch times, the etch patterns provided by such specific combinations can be determined. One possible example of such etch patterns is described below with respect to FIGS. 3-7.

Figure 3:
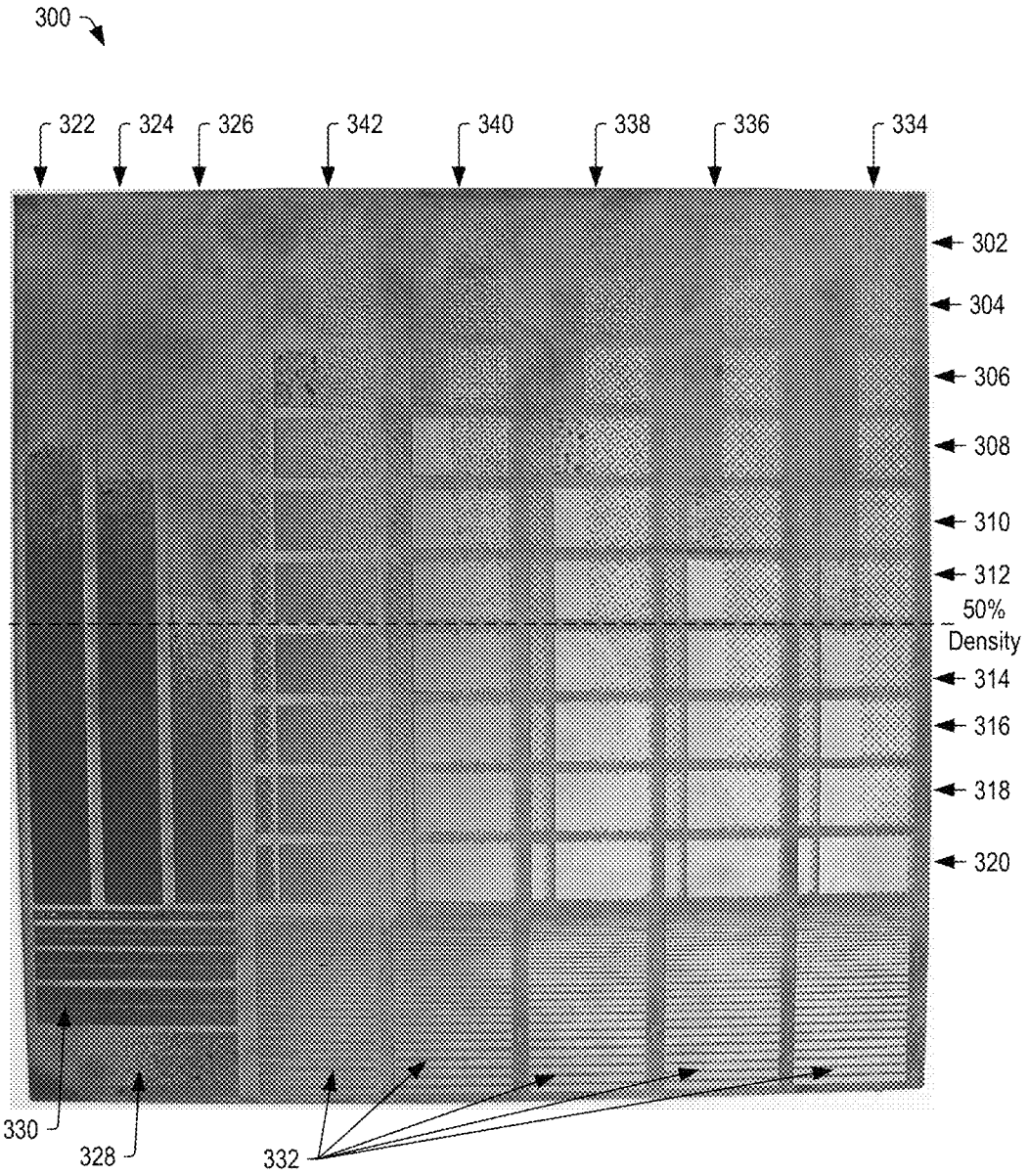
FIG. 3 depicts a photograph of an etched metal substrate formed by applying the multi-component mask of FIG. 2 and by exposing the substrate to an etching bath, in accordance with certain embodiments of the present disclosure.

FIG. 3 depicts a photograph of an etched metal substrate 300 formed by applying the multi-component mask of FIG. 2 and by exposing the substrate to an etching bath, in accordance with certain embodiments of the present disclosure. The substrate 300 may include a plurality of blocks formed by etching a substrate printed with the mask 200 of FIG. 2, including different pigments, pigment combinations and densities and different ink patterns. In the illustrated example, the row 302 depicts an etch pattern of blocks produced by a mask having a ten percent (10%) density. Row 304 depicts an etch pattern of blocks produced by a mask having a twenty percent (20%) density. Row 306 depicts an etch pattern of blocks produced by a mask having a thirty percent (30%) density. Row 308 depicts an etch pattern of blocks produced by a mask having a forty percent (40%) density. Row 310 depicts blocks having a fifty percent (50%) density. Row 312 depicts an etch pattern of blocks produced by a mask having a sixty percent (60%) density. Row 314 depicts an etch pattern of blocks produced by a mask having a seventy percent (70%) density. Row 316 depicts an etch pattern of blocks produced by a mask having an eighty percent (80%) density. Row 318 depicts an etch pattern of blocks produced by a mask having a ninety percent (90%) density. Row 320 depicts an etch pattern of blocks produced by a mask having one hundred percent (100%) density. The blocks 302-320 may utilize a standard printer ink distribution, which may be stochastic, may utilize a uniform or custom distribution of ink using a screen or using custom printer control firmware for a custom pattern of ink distribution, depending on the implementation.

In FIG. 3, columns 334, 336, 338, 340, and 342 represent etch patterns produced by the mask 200 in FIG. 2. Column 334 represents etch patterns formed using a black pigment. Column 336 represents etch patterns formed using a mask including a combination of black and cyan pigments. Column 338 represents etch patterns formed using a mask including a combination of black, cyan, and magenta pigments. Column 340 represents etch patterns formed using a mask including a combination of black, cyan, magenta, and yellow pigments. Column 342 represents etch patterns formed using a mask including a combination of black, cyan, magenta, yellow, and white pigments. It should be appreciated that the particular pigments and pigment combinations represent just one possible example out of many different possible combinations.

In column 334, it can be seen that a single color mask of black may experience etching at each density up to approximately one hundred percent (100%) density at 320. In column 338, it can be seen that the mask that includes black, cyan, and magenta has limited etching at seventy percent (70%) density. In column 342, it can be seen that the mask that includes black, cyan, magenta, yellow, and white has little etching at densities as low as fifty percent (50%).

At 322, the mask of black, cyan, magenta, yellow is shown to experience etching until approximately thirty-five percent (35%) density. At 324, the mask of black, cyan, magenta, and yellow experiences etching until approximately forty percent (40%) density. At 326, the mask of black experiences etching until approximately sixty-five percent (65%) density. The mezzotint area 328 demonstrated etching until about fifty-five (55%) density. The line thicknesses at 323 show that mask thicknesses hold to approximately 1 pixel width, though such thin lines experience some etching (undercut). The inverse lines 330 demonstrate that line widths of only one pixel do not etch well, though thicker lines can be readily produced.

Figure 4:
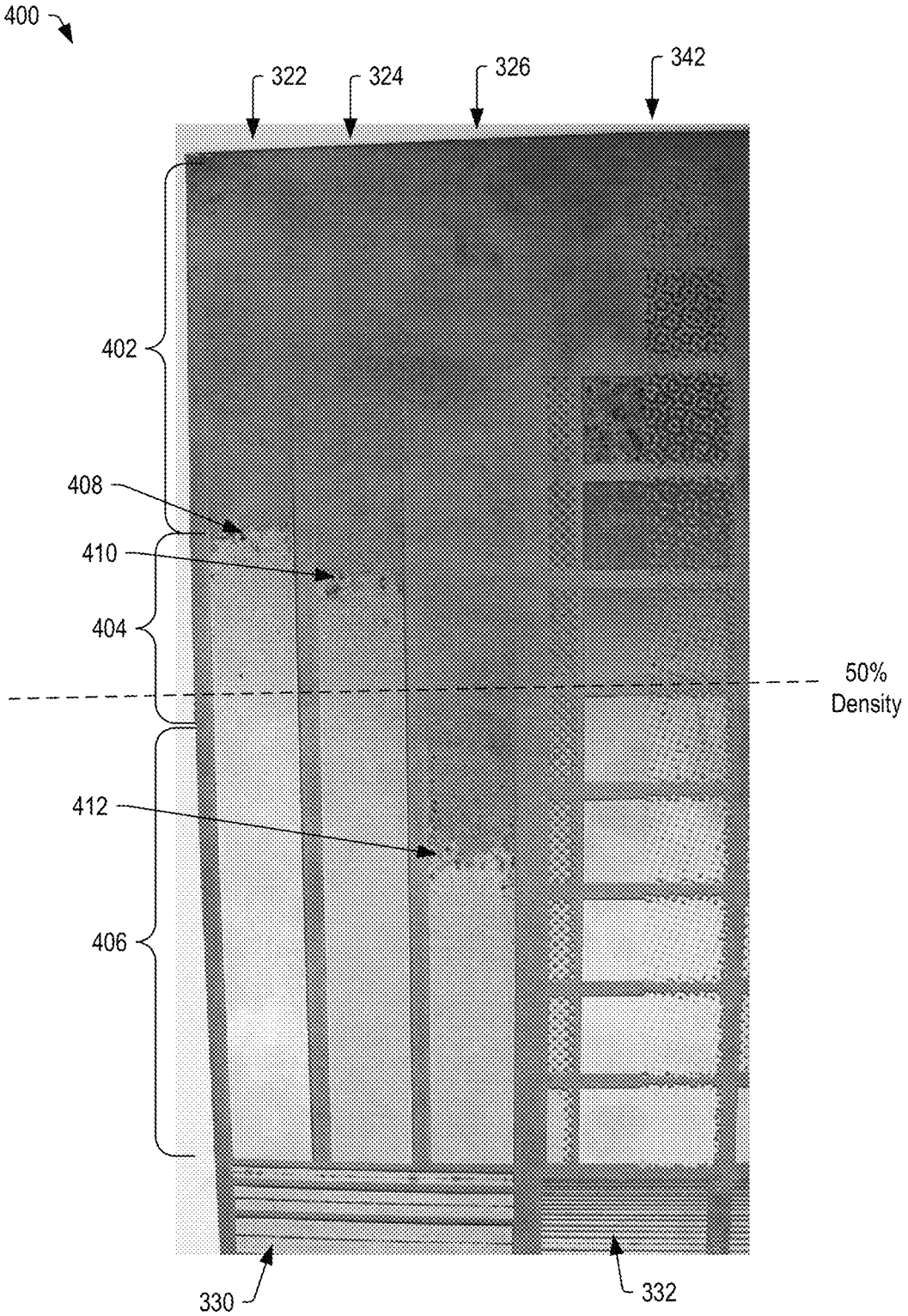
FIG. 4 depicts a photograph of a portion of the etched metal substrate of FIG. 3 including an etched area formed by a portion of the mask of FIG. 2 having a gradient formed using a screened printing pattern, in accordance with certain embodiments of the present disclosure.

FIG. 4 depicts a photograph of a portion 400 of the etched metal substrate 300 of FIG. 3 including an etched area formed by a portion of the mask of FIG. 2 having a gradient formed using a screened printing pattern, in accordance with certain embodiments of the present disclosure. In the portion, at gradient area 322, the substrate 300 experiences etching within a first region 402. Within a second region 404, the etching declines, and within a third region 406, the surface of the substrate 300 is not etched. At 408, the gradient area 322 shows that the mask begins to protect the substrate at about thirty-five percent (35%) density. In the gradient area 324, the mask begins to protect the substrate at about forty percent (40%) density, as generally indicated at 410. In the gradient area 326, the mask begins to protect the substrate at about sixty-five percent (65%) density, as generally indicated at 412.

Further, in the portion 400, the inverse etch lines 330 can be seen and it is clear that the one pixel etch line is not completely etched. In contrast, the line thicknesses 322 may hold at widths of approximately one pixel, with noticeable etching due to undercut.

Further, the print pattern at column 342 demonstrates noticeable etching to approximately fifty-percent (50%) ink density of the mask 200. Above fifty-percent (50%) ink density, the mask 200 significantly inhibits etching of the substrate.

Figure 5:
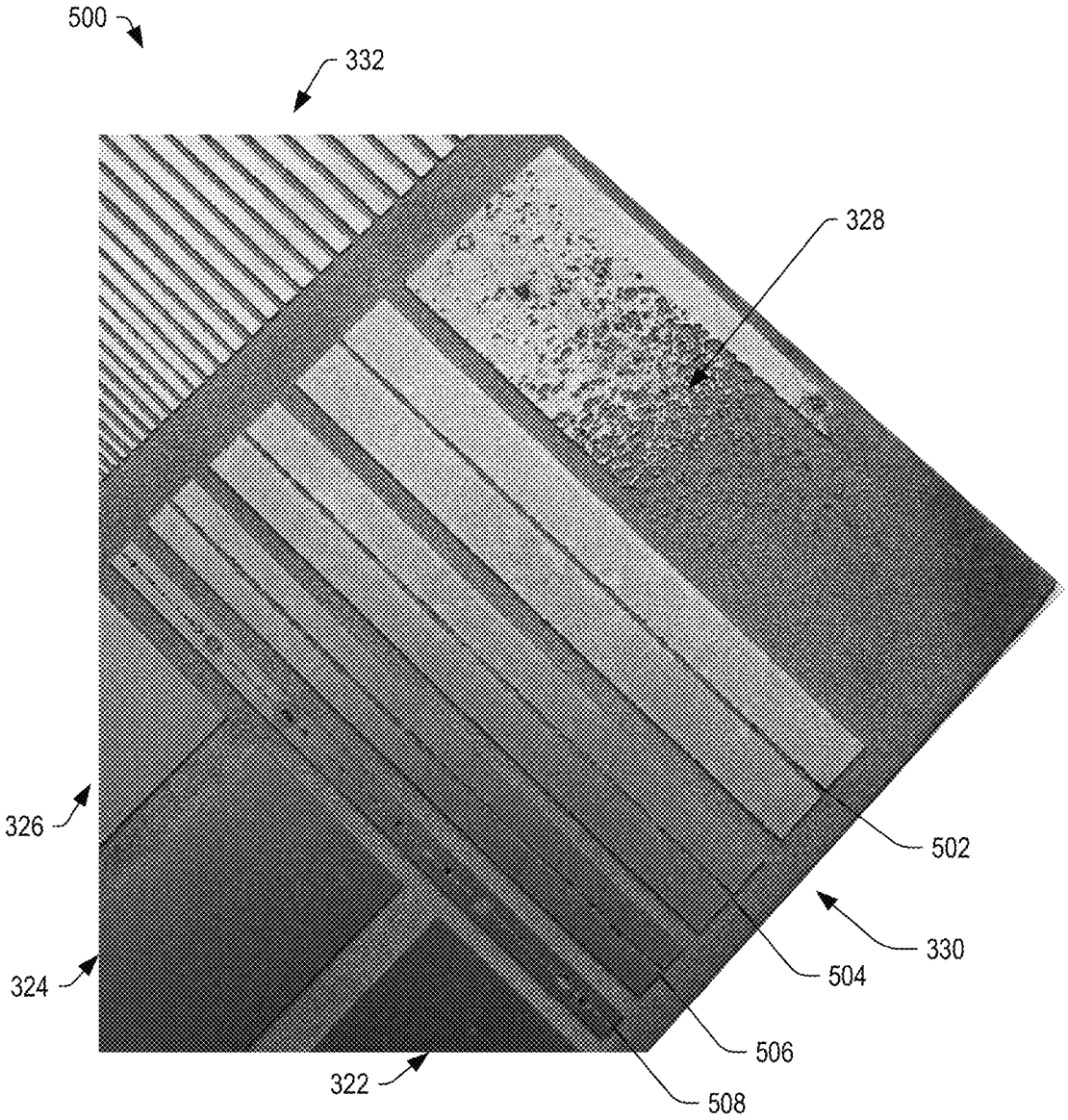
FIG. 5 depicts a photograph of a portion of the etched metal substrate of FIG. 3 including an etched area formed by a portion of the mask of FIG. 2 having a gradient formed using a mezzotint pattern, in accordance with certain embodiments of the present disclosure.

FIG. 5 depicts a photograph of a portion 500 of the etched metal substrate 300 of FIG. 3 including an etched area formed by a portion of the mask 200 of FIG. 2 having a gradient formed using a mezzotint pattern, in accordance with certain embodiments of the present disclosure. The portion 500 shows inverse lines 502, 504, 506, and 508, which are formed by applying a mask 200 with lines of varying pixel widths left unmasked to etch the line. At 508, a pixel width of one pixel demonstrates flaws in the etch line. At 506, a pixel width of two pixels produces a consistent etch. A three pixel width at 504 and a five pixel width at 502 demonstrate a relatively good etch. Further, the mezzotint area 328 shows significant etching even at one hundred percent (100%) density of the mezzotint area 228 of the mask 200.

Figure 6:
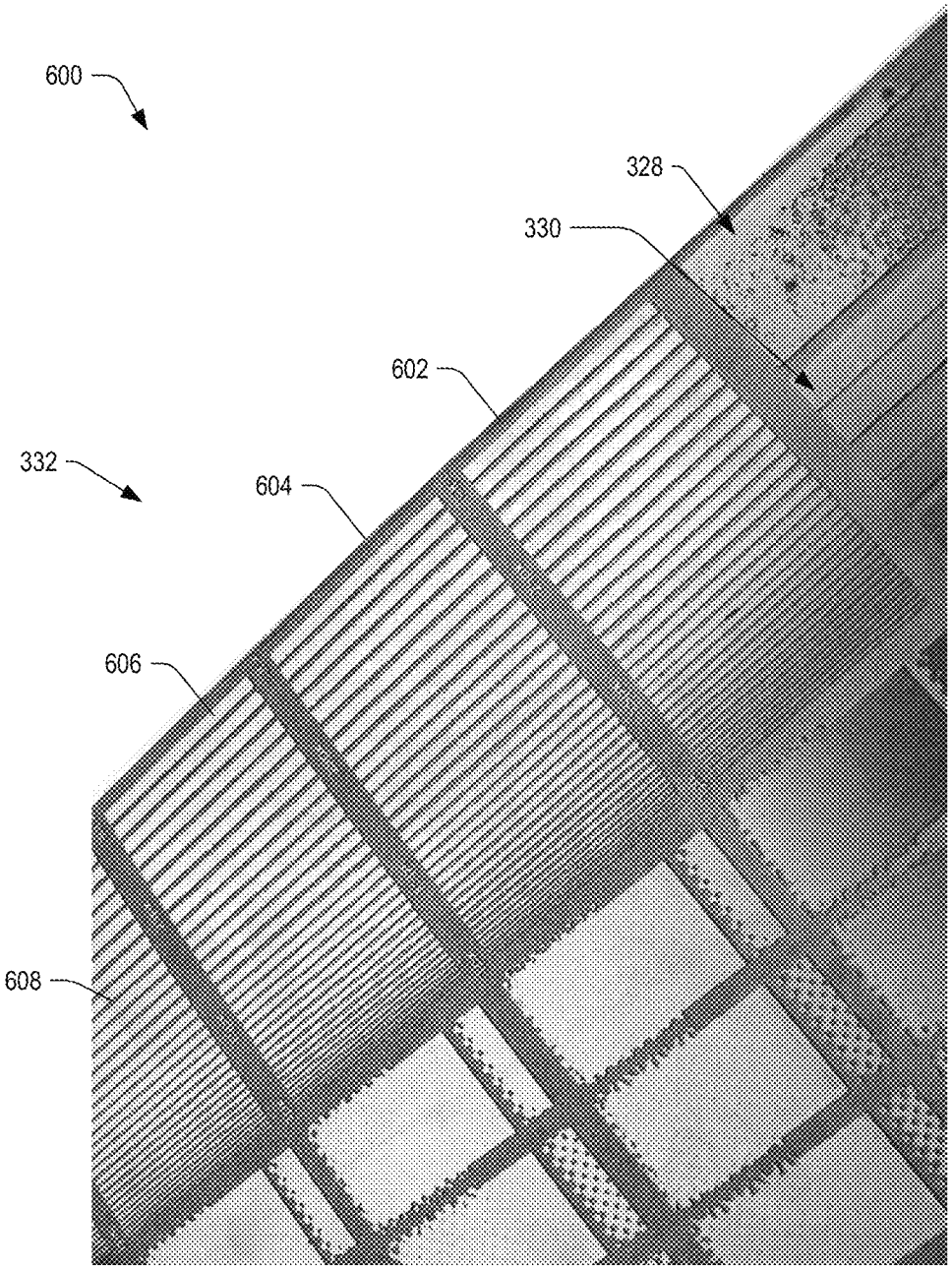
FIG. 6 depicts a photograph of a portion of the etched metal substrate of FIG. 3 including an etched area formed by a portion of the mask of FIG. 2 having lines of different thickness, in accordance with certain embodiments of the present disclosure.

FIG. 6 depicts a photograph of a portion 600 of the etched metal substrate 300 of FIG. 3 including an etched area formed by a portion of the mask 200 of FIG. 2 having lines of different thickness, in accordance with certain embodiments of the present disclosure. The line area 332 may be formed using a mask of one hundred percent (100%) density of the various color combinations. At 602, the lines may be formed using black, cyan, magenta, yellow, and white. At 604, the lines may be formed using black, cyan, magenta and yellow. At 606, the lines may be formed using black, cyan, and magenta. At 608, the lines may be formed using black and cyan. Other combinations of pigment compositions and other densities may be used, depending on the implementation.

Figure 7:
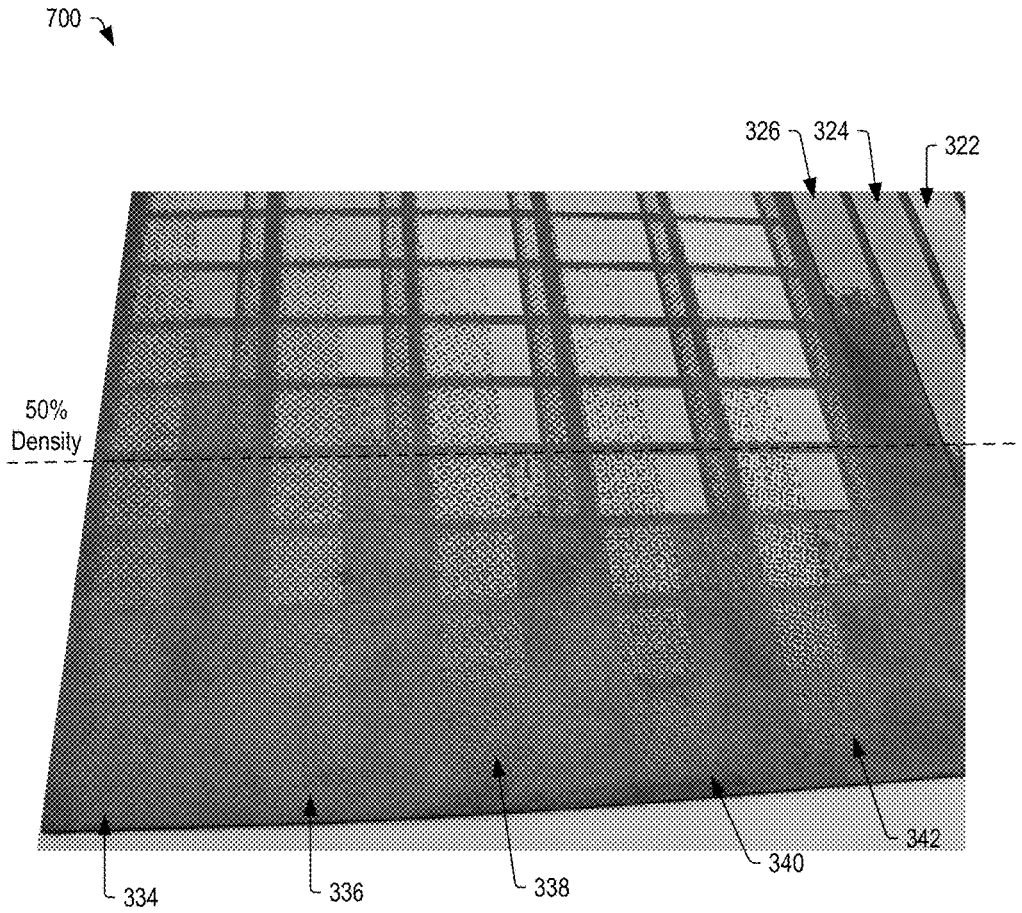
FIG. 7 depicts a photograph of a portion of the etched metal substrate of FIG. 3 including an etched area formed by a portion of the mask of FIG. 2 having different densities and print patterns, in accordance with certain embodiments of the present disclosure.

FIG. 7 depicts a photograph of a portion 700 of the etched metal substrate 300 of FIG. 3 including an etched area formed by a portion of the mask 200 of FIG. 2 having different densities and print patterns, in accordance with certain embodiments of the present disclosure. The portion 700 shows the etch corresponding to the black mask 334, the black/cyan mask 336, the black/cyan/magenta mask 338, the black/cyan/magenta/yellow mask 340, and the black/cyan/magenta/yellow/white mask 342. In the illustrated example, the etch pattern of the blocks indicated at 334, 336, 338, 340, and 342 represents the ink pattern of the mask 200.

Figure 8:
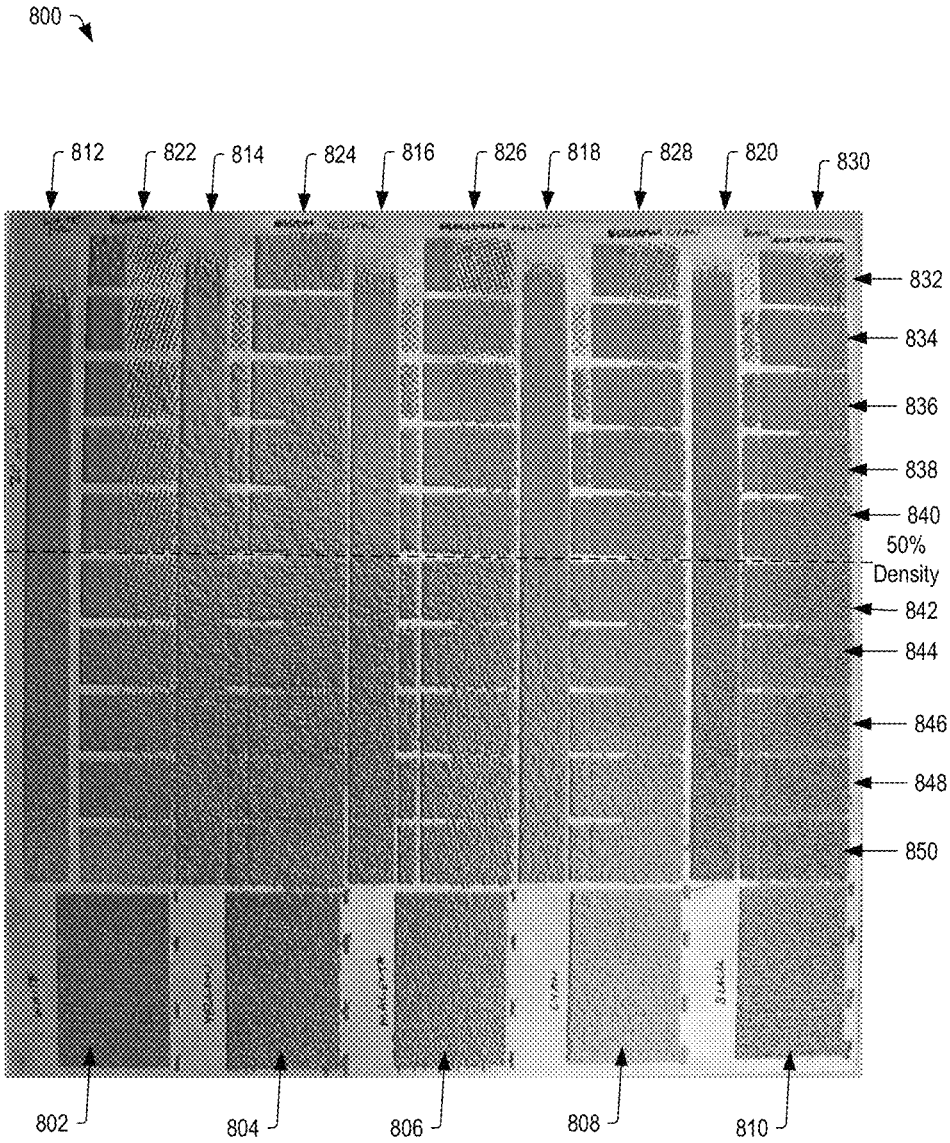
FIG. 8 depicts a photograph of a substrate including different pigments, different ink densities and including thermoplastic material, in accordance with certain embodiments of the present disclosure.

FIG. 8 depicts a photograph of a substrate 800 including different pigments, different ink densities and including thermoplastic material, in accordance with certain embodiments of the present disclosure. At 802, a column formed using white pigment with thermoplastic material is shown. At 804, a column formed using yellow pigment and thermoplastic is shown. At 806, a column formed using magenta pigment and thermoplastic is shown. At 808, a column formed using cyan pigment and thermoplastic is shown. At 810, a column formed using black pigment and thermoplastic is shown.

The column 802 includes lines, a gradient 812, and blocks 822 having different ink densities ranging from 10% to 100% density. The column 804 includes lines, a gradient 814, and blocks 824 having different ink densities. The column 806 includes lines, a gradient 816, and blocks 826 of different ink densities. The column 808 includes lines, a gradient 818, and blocks 828 of different ink densities. The column 810 includes lines, a gradient 820, and blocks 830 of different ink densities. The ink densities may include ten percent indicated at 832, twenty percent indicated at 834, thirty percent indicated at 836, forty percent indicated at 838, fifty percent indicated at 840, sixty percent indicated at 842, seventy percent indicated at 844, eighty percent indicated at 846, ninety percent indicated at 848, and one hundred percent indicated at 850.

In the illustrated example, an ink mask may be printed onto the substrate 800 and the ultraviolet light may be at least partially blocked to prevent curing of the ink. After application of the ink, thermoplastic material may be applied to the substrate 800 in a substantially uniform layer, and excess material may be removed by tipping the substrate or by exposing the substrate to a vacuum or to a blower. After removal of the excess thermoplastic material, ultraviolet light may be applied to cure the ink, which may capture or trap the remaining thermoplastic material in the ink. Further, the substrate 800 may be heated to melt the thermoplastic. In certain embodiments, the ultraviolet light and heat may be applied at the same time. In some embodiments, the heat may be applied without ultraviolet curing. Other embodiments are also possible.

In the illustrated example, the cyan ink and thermoplastic may produce a relatively smooth surface at a range from 20% density to 100% density. In contrast, yellow and magenta produced relatively smooth surfaces at lower densities, such as below fifty percent. The white and black inks produced a more textured finish at high densities. In certain embodiments, to achieve a smooth texture of a particular color, a low density of ink may be applied to the surface, while higher texture may be achieved using a higher density of the ink.

Figure 9:
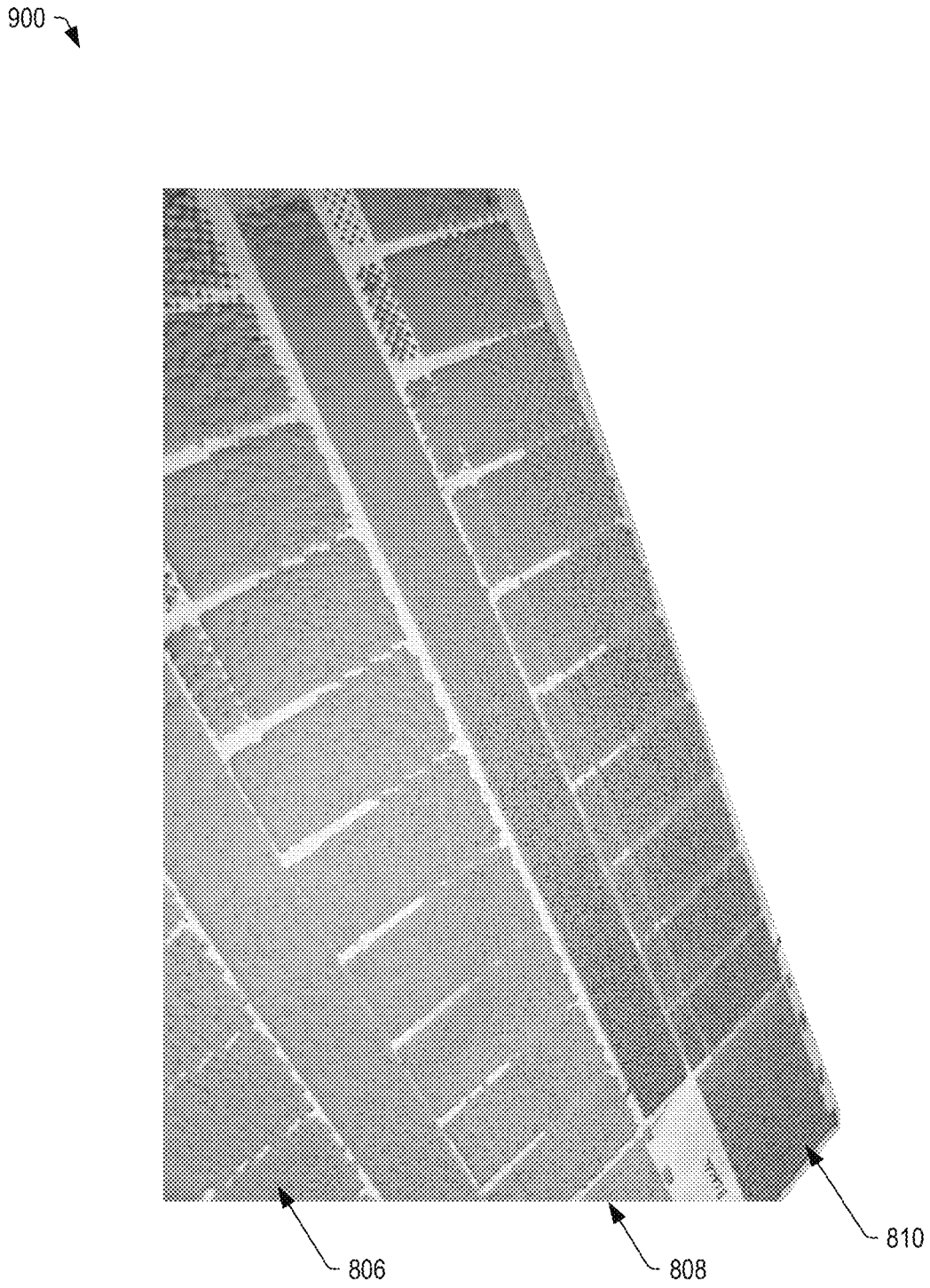
FIG. 9 depicts a photograph of a portion of the substrate of FIG. 8.

FIG. 9 depicts a photograph of a portion 900 of the substrate 800 of FIG. 8. The portion 900 includes the black column 810, the cyan column 808, and the magenta column 806 of the substrate 800. In this example, at the higher densities, the texture of the ink/thermoplastic composition becomes visible. At lower densities, the ink/thermoplastic composition produces a smooth surface. By varying the composition and composition density, a selected texture of the finished surface may be achieved.

Figure 10:
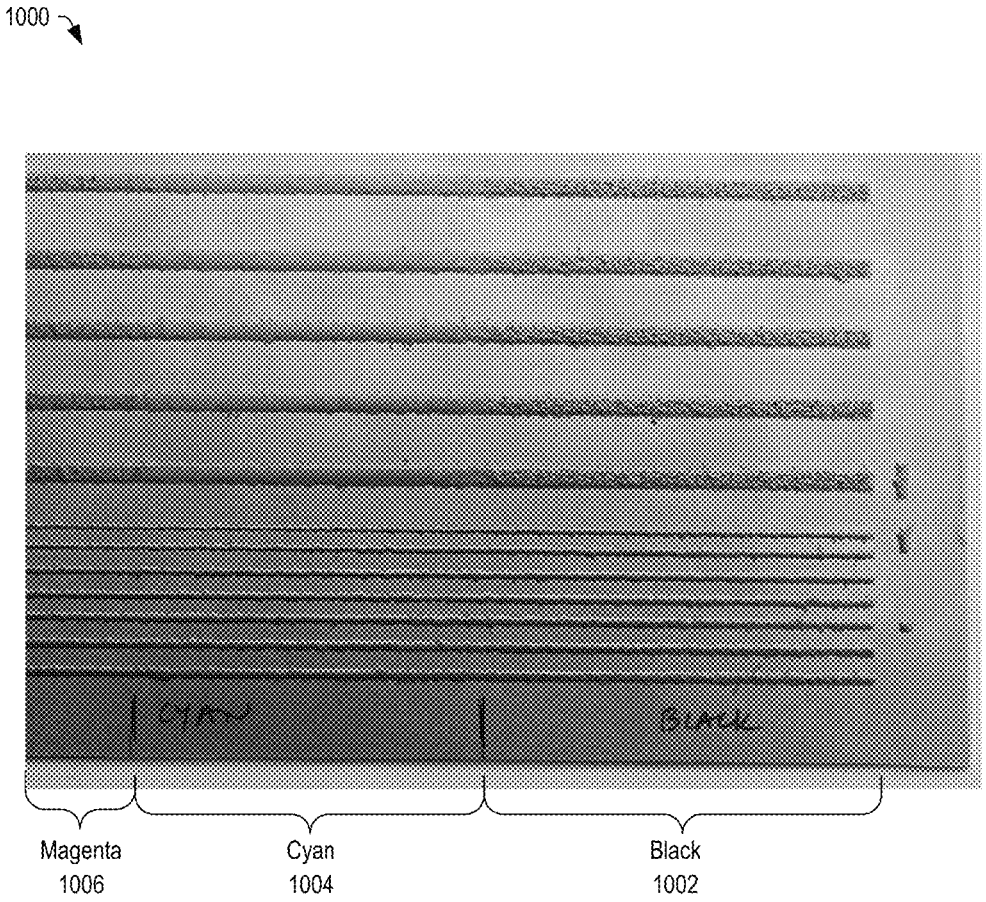
FIG. 10 depicts a photograph of a portion of a substrate including different inks and different line thickness and including thermoplastic material, in accordance with certain embodiments of the present disclosure.

FIG. 10 depicts a photograph of a portion of a substrate 1000 including different inks and different line thickness and including thermoplastic material, in accordance with certain embodiments of the present disclosure. The substrate 1000 depicts lines of different thicknesses formed using ink and thermoplastic in the same technique described above with respect to FIGS. 8 and 9. In the illustrated example, the substrate 1000 was printed using black ink at 1002, cyan ink 1004, and magenta ink 1006.

Figure 11:
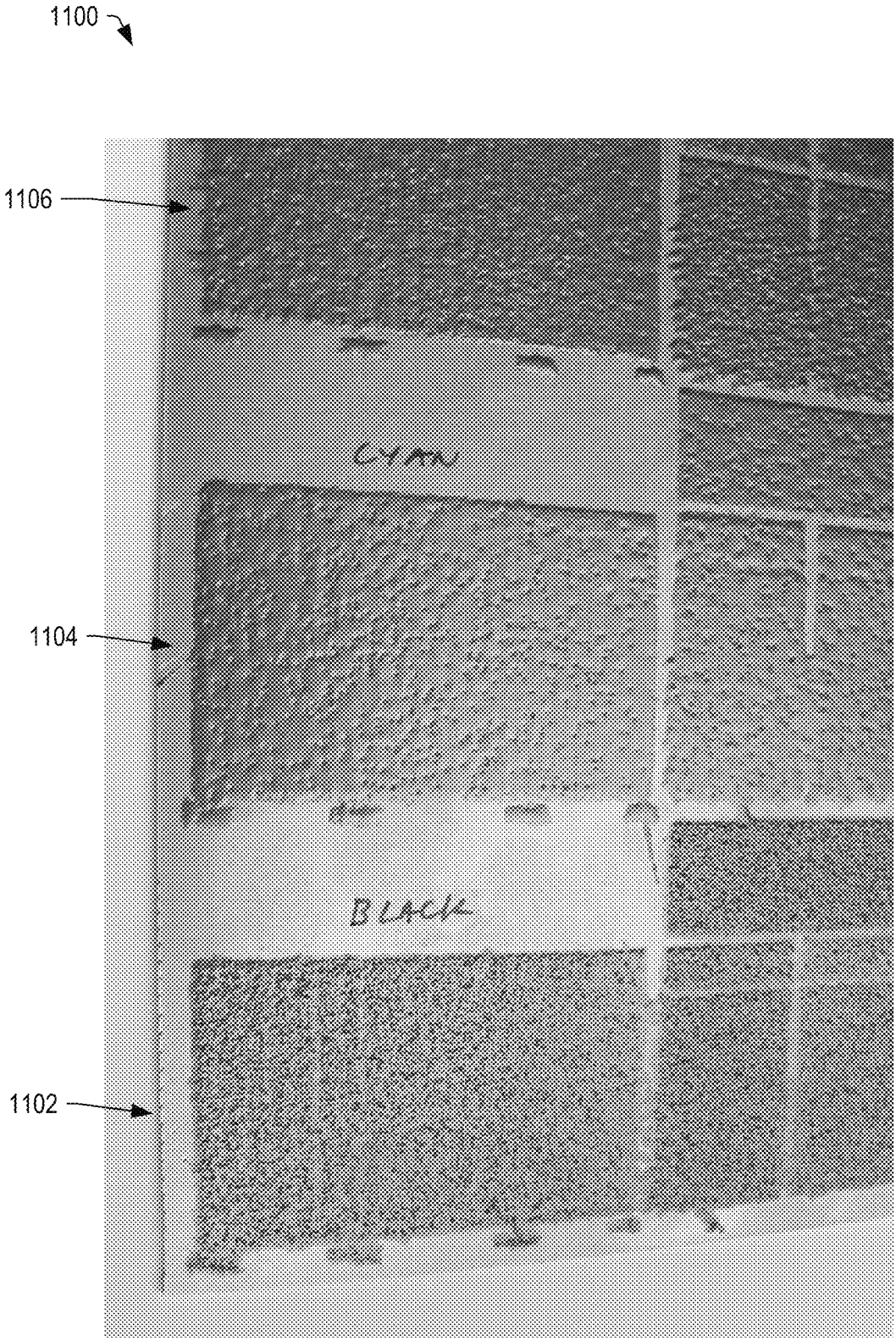
FIG. 11 depicts a photograph of a portion of the substrate of FIG. 8.

FIG. 11 depicts a photograph of a portion 1100 of the substrate of FIG. 8. The portion 1100 shows the texture of the black ink and thermoplastic combination 1102 as being visibly greater than the texture of the cyan ink and thermoplastic combination 1104. Similarly, the magenta and thermoplastic combination 1106 shows greater texture than the cyan and thermoplastic combination 1104. As previously discussed, the ink may be deposited on the substrate 800 at a selected density and without ultraviolet curing (or with limited ultraviolet curing). The thermoplastic may be applied in a substantially uniform coat and then the excess thermoplastic may be removed. Subsequently, the ink/thermoplastic composition may be exposed to ultraviolet light, and the substrate may be heated.

Figure 12:
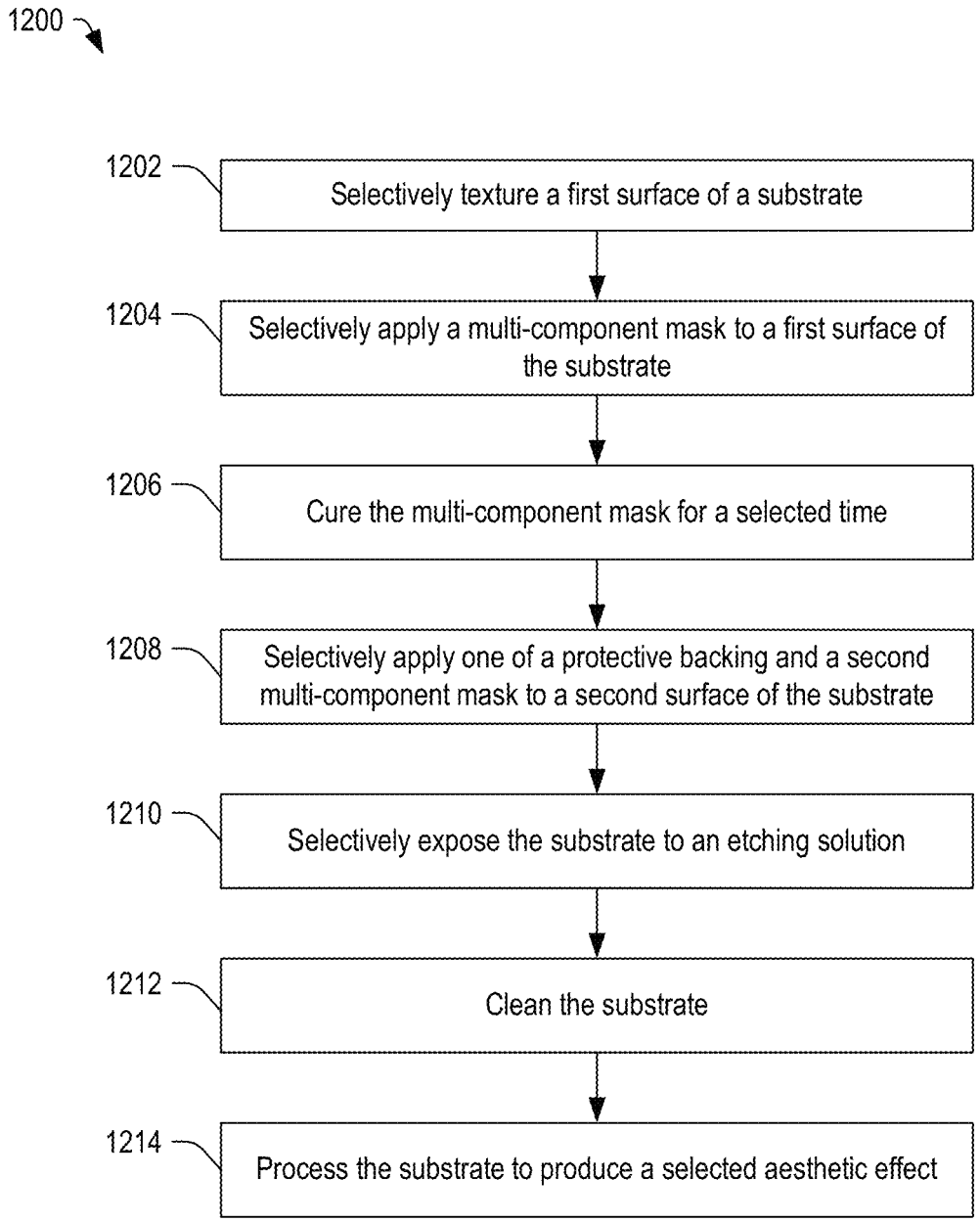
FIG. 12 illustrates a flow diagram of a method of producing a multi-dimensional visual art work, in accordance with certain embodiments of the present disclosure.

FIG. 12 is a flow diagram of a method 1200 of producing a multi-dimensional visual art work, in accordance with certain embodiments of the present disclosure. At 1202, the method 1200 may include selectively texturing a surface of a substrate. The substrate may be cleaned using a degreaser and sanded using sand paper or other abrasive material to create a little texture that may operate to facilitate a bond between the substrate and a mask.

At 1204, the method 1200 may include selectively applying a multi-component mask to a first surface of the substrate. The multi-component mask may be printed onto the substrate using a UV printer. The number of pigment compositions applied and their respective densities may determine the amount of pitting or etching that may occur to the substrate when exposed to the etch bath. The multi-component mask may be formed from spatially distinct pigments, spatially varying pigment combinations, and spatially varying pigment densities that vary across the first surface of the substrate. In an example, the mask may be formed from a single pigment composition of non-uniform density (where the mask is applied and not including the spaces where the mask is not applied). Further, the mask may be formed from multiple layers of pigment compositions in some areas and from one or more pigment compositions in other areas. Further, the density of the pigment composition or compositions may vary across the mask. In some embodiments, the chemical composition of the ink may impact the adhesion or bond quality with respect to the substrate surface. The adhesion may vary from supplier to supplier. Further, in some embodiments, the percentage or density of one or more of the pigments may be reduced with more pigment composition layers. Further, the densities of the inks can vary within a combination of pigments. The percentage of coverage or density may be increased when a single pigment is used.

At 1206, the method 1200 can include curing the pigment mask for a selected time. Curing may include exposing the pigment mask to ultraviolet light, storing the substrate for a pre-determined time to allow the pigment to dry, or any combination thereof. The cure time may be selected to enhance the bond and protective nature of the ink as a mask.

At 1208, the method 1200 may include selectively applying one of a protective coating and a second multi-component mask to a second surface of the substrate. The protective coating may prevent the second surface from becoming etched during a subsequent etching process. In some embodiments, the protective coating may be formed form a vinyl material, a clear coat material, or another material configured to protect the second surface of the substrate.

At 1210, the method 1200 can include selectively exposing the substrate to an etching solution. In an example, the substrate may be immersed in the etching solution or the first surface may be immersed in the etching solution. The etching solution may be an acid bath, a copper sulfate salt bath, a saline solution bath, or another etching solution. The solution strength and the time in solution may be determined in relation to the intended etch depth, the pigment density, the solution strength, the cure time of the mask, or any combination thereof.

At 1212, the method 1200 may include cleaning the substrate. The substrate may be cleaned using a power wash or using a cleaning solvent, such as a methyl ethyl ketone. The cleaning operation may remove any remaining etching solution as well as the mask.

At 1214, the method 1200 can include processing the substrate to produce a selected aesthetic effect. In addition to drying the etched substrate, various further processing steps may be performed on the substrate to produce an aesthetic workpiece, such as a multi-dimensional work of art. Some of the further processing steps or operations are described below with respect to FIGS. 13A-15.

Figure 13A:
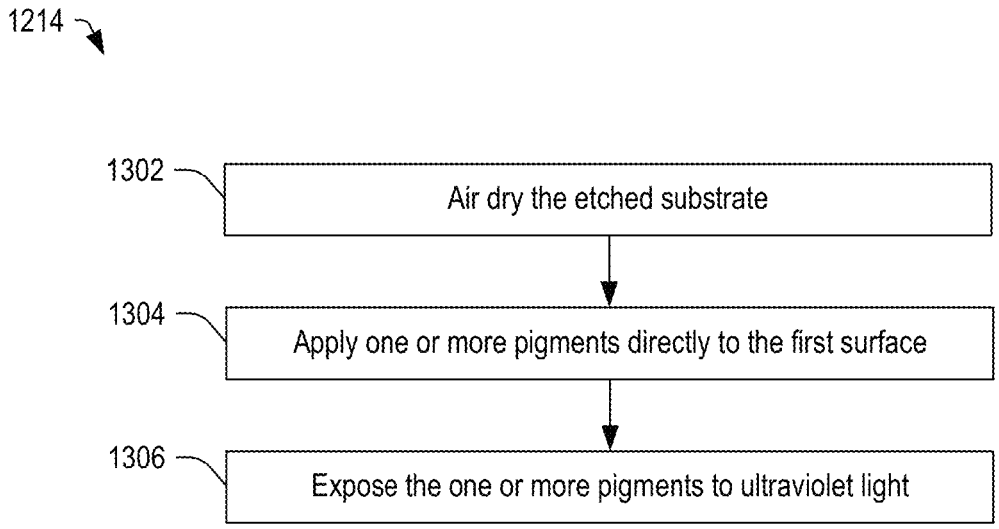
FIGS. 13A and 13B depict flow diagrams of methods of finishing the multi-dimensional visual art work continued from FIG. 12, in accordance with certain embodiments of the present disclosure.
Figure 13B:
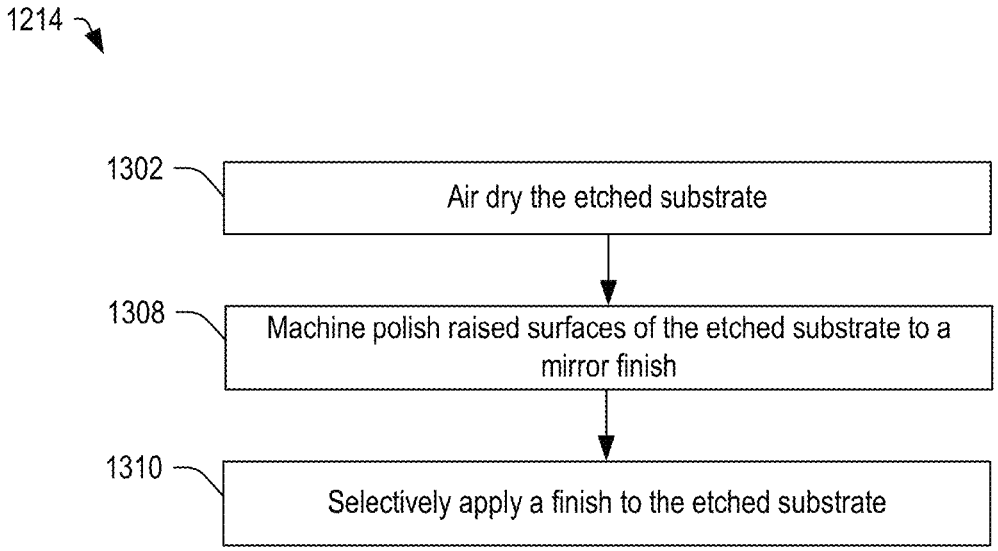

FIGS. 13A and 13B are flow diagrams of methods of finishing the multi-dimensional visual art work, in accordance with certain embodiments of the present disclosure. In FIG. 13A, a method 1214 may include air drying the etched substrate, at 1302. In some embodiments, the drying process may be accelerated by directing air onto the substrate (increasing air flow, such as by a fan), by heating, or any combination thereof.

At 1304, the method 1214 may include applying at least one pigment directly to the first surface. In an example, one or more pigments may be printed onto the etched surface, such that the ink may be printed into the etched areas, on non-etched surfaces, or any combination thereof.

At 1306, the method 1214 can include exposing the at least one pigment to ultraviolet light. In some embodiments, the UV light may be part of the printer that applies the pigment. In some embodiments, the UV light may be separate from the printer.

In the example of FIG. 13A, the resulting multi-dimensional workpiece may include one or more pigments, some of which may adhere to the substrate within etched areas, causing the reflection of light to vary based on the variations within the etched areas. Further, pigments that adhere to the un-etched portions may reflect more light than etched areas, providing monochromatic shading visual effect. In some embodiments, a clear coat layer or other protective layer may be formed over the surface.

In FIG. 13B, the method 1214 may include air drying the etched substrate, at 1302. At 1304, the method may further include machine polishing raised surfaces of the etched substrate to a mirror finish, at 1308. In some embodiments, the raised surfaces may include the surface areas of the etched surface of the substrate that were protected by the mask during the etching operation. In some embodiments, the machine polishing operation may smooth the raised surfaces without achieving a mirror finish. Other embodiments are also possible.

At 1310, the method 1214 may include selectively applying a finish to the etched substrate. In some examples, the finish may include a clear coat, a clear laminate surface, another protective coating, or any combination thereof.

Figure 14:
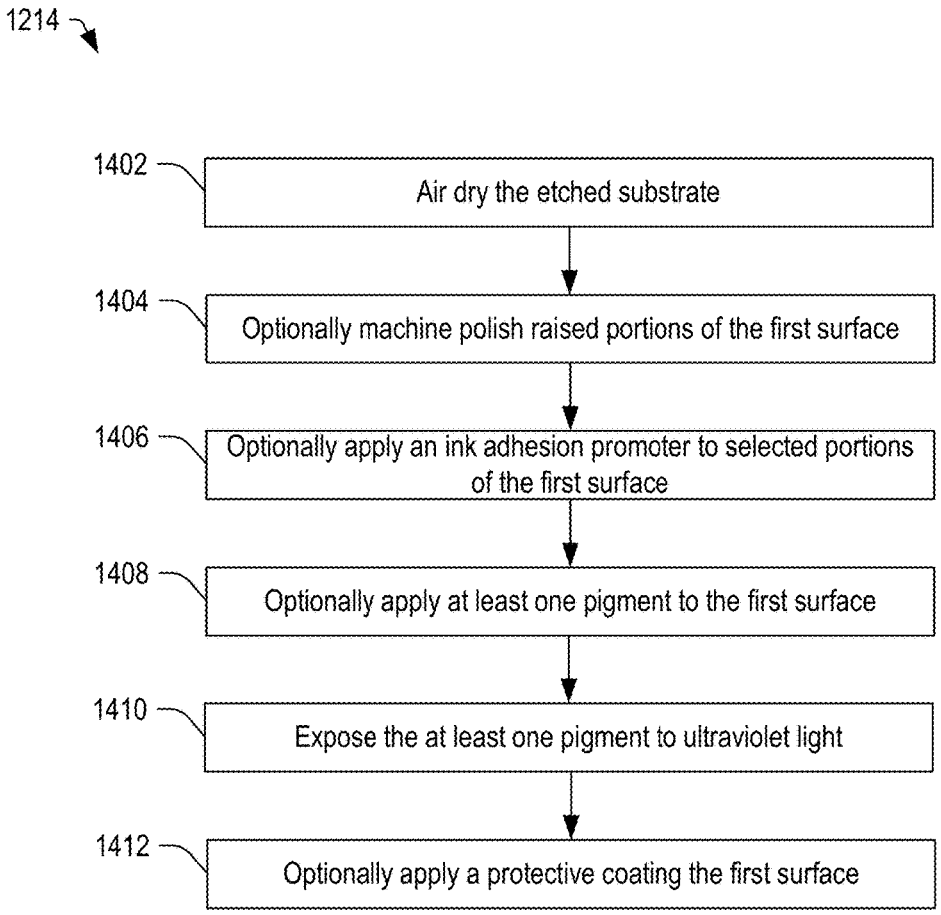
FIG. 14 illustrates a flow diagram of a method of finishing the multi-dimensional visual art work continued from FIG. 12, in accordance with certain embodiments of the present disclosure.

FIG. 14 is a flow diagram of a method 1214 of finishing the multi-dimensional visual art work, in accordance with certain embodiments of the present disclosure. At 1402, the method 1214 may include air drying the etched substrate. At

1404, the method 1214 may include optionally machine polishing raised portions of the first surface. The raised portions may include the surface portions of the substrate that were not etched such that they are raised relative to the etched portions.

At 1406, the method 1214 may include optionally applying an adhesion promoter to selected portions of the first surface. The adhesion promotor is a chemical that acts as an ink promoter configured to facilitate adhesion between the ink and the substrate.

At 1408, the method 1214 includes optionally applying at least one pigment to the first surface. In an example, by applying a single pigment to the first surface, a monochrome image may be produced. The color may only reflect from the unetched surface while the color in the etched portions may produce monochrome shading, reflecting color to varying degrees depending on the angle of the etched surface relative to the unetched surface.

At 1410, the method 1214 includes exposing the at least one pigment to ultraviolet light. In some examples, the ink may be applied by a UV printer, which may also at least initially cure the ink using the UV light. In some embodiments, the UV light of the printer may be obstructed, and the ink may be printed in such a way as to allow the ink to flow before curing. Other embodiments are also possible.

At 1412, the method 1214 may further include optionally applying a protective coating the first surface of the substrate. The protective coating may be a clear coat seal that may be configured to seal the ink to the substrate and to protect the substrate from exposure to the environment. In another embodiment, the protective coating may include a laminate coating. Other embodiments are also possible.

Figure 15:
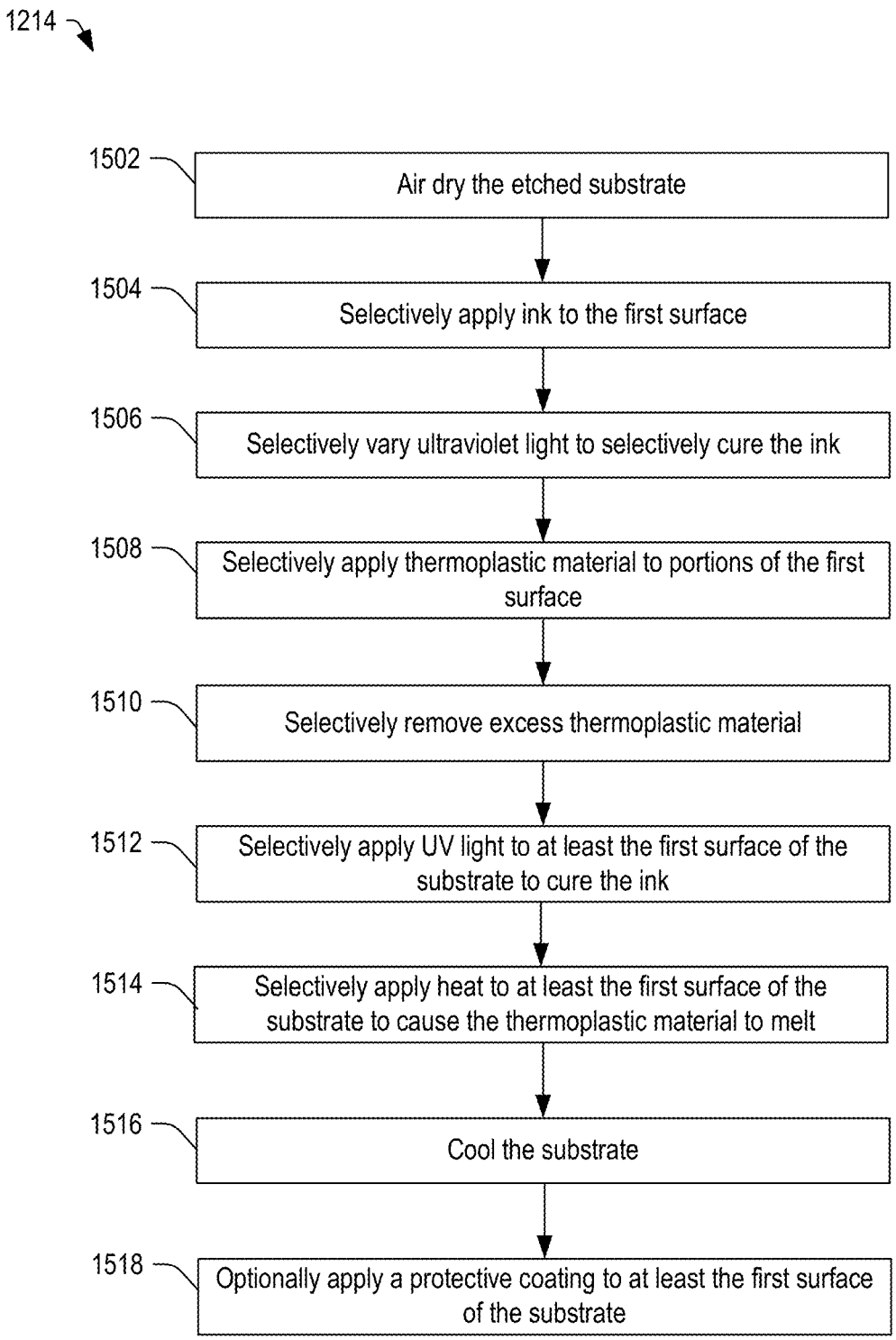
FIG. 15 depicts a flow diagram of a method of finishing the multi-dimensional visual art work continued from FIG. 12, in accordance with certain embodiments of the present disclosure.

FIG. 15 is a flow diagram of a method 1214 of finishing the multi-dimensional visual art work, in accordance with certain embodiments of the present disclosure. At 1502, the method 1214 may include air drying the etched substrate. In some examples, air drying may include applying heat, exposing the substrate to a blower or fan, or any combination thereof.

At 1504, the method 1214 may include selectively applying ink to the first surface. The ink may be applied using a UV printer. In an example, the UV printer may include a UV light element that can be controlled. In an embodiment, the amount of ink to be applied may be reduced by a couple of pixels along each edge of the print area to allow for flow of the uncured ink. By reducing the print area of each portion of the image by a couple of pixels, the ink may flow while remaining within the print area.

At 1506, the method 1214 may include selectively varying ultraviolet light to selectively cure the ink. In an example, the UV light of the printer may be turned off or obstructed to prevent exposure of the ink to the light. Other embodiments are also possible.

At 1508, the method 1214 may include selectively applying thermoplastic material to portions of the first surface. The thermoplastic or thermographic material may be sprinkled or otherwise applied to the first surface. In an example, the thermographic material may be applied to uncured ink on the first surface. At 1510, the method 1214 may include removing excess thermographic material.

At 1512, the method 1214 may include selectively applying ultraviolet light to at least the first surface of the substrate to cure the ink. The ink may adhere to the thermoplastic and to the surface of the substrate, and curing of the ink may help to bond the thermoplastic to the surface.

At 1514, the method 1214 may include selectively applying heat to at least the first surface of the substrate to cause the thermoplastic material to melt. The melted thermoplastic may flow and form a textured portion, at least in conjunction with the printed areas.

At 1516, the method 1214 may include cooling the substrate. In an example, the substrate may be removed from the heat and set aside to air cool. In another example, the substrate may be cooled using a refrigeration-type of unit.

At 1518, the method 1214 may include optionally applying a protective coating to at least the first surface of the substrate. In an example, the protective coating may include a clear coat material, a laminate material, another protective layer, or any combination thereof. Other embodiments are also possible.

Figure 16:
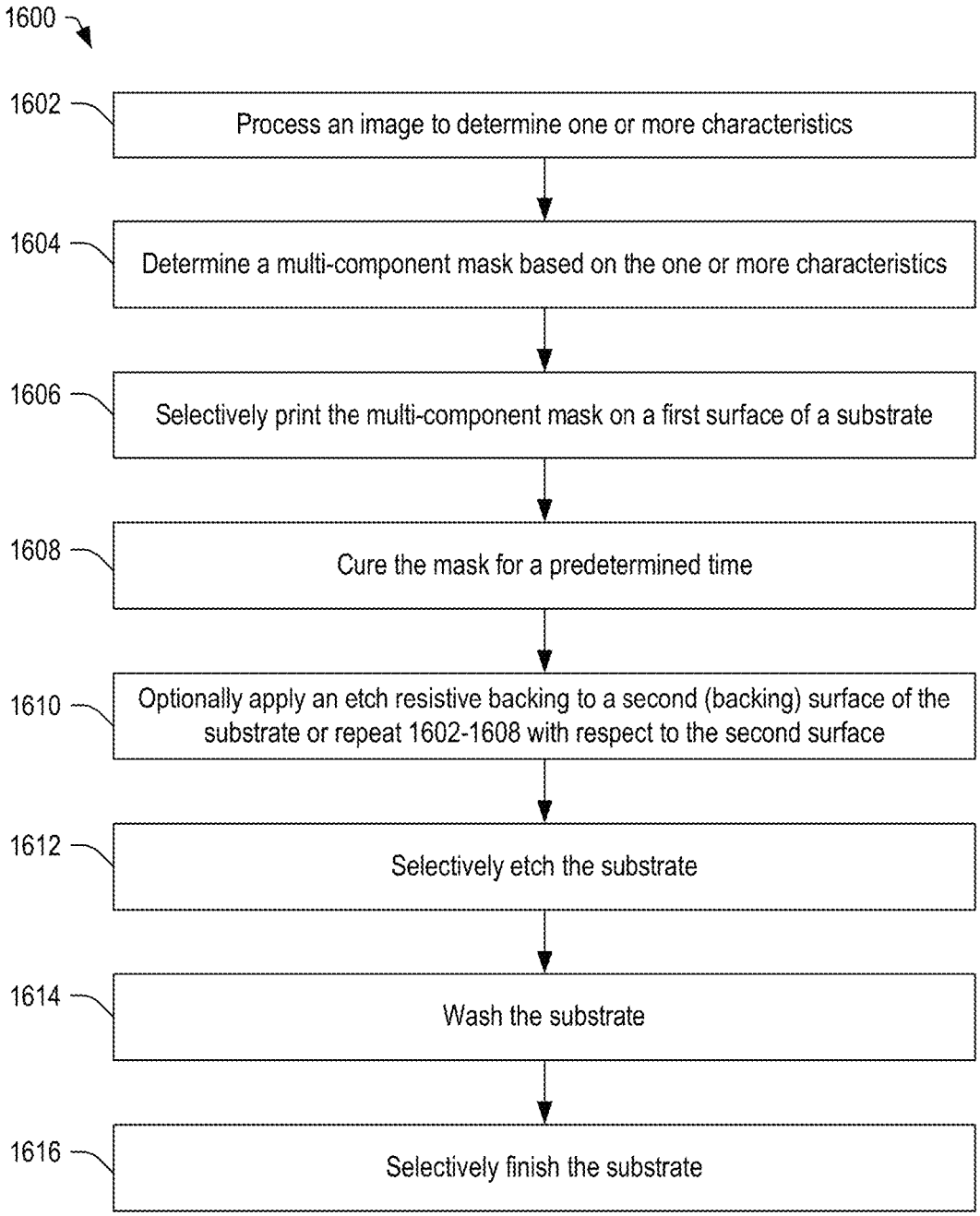
FIG. 16 depicts a flow diagram of a method of producing a multi-dimensional visual art work, in accordance with certain embodiments of the present disclosure.

FIG. 16 is a flow diagram of a method 1600 of producing a multi-dimensional visual art work, in accordance with certain embodiments of the present disclosure. At 1602, the method 1600 may include processing an image to determine one or more characteristics. In an example, the image may be sized to fit the desired output size. For example, a 10 megapixel photograph may be sized to be printed on a 3 foot by 4 foot substrate or for an 8 foot by 10 foot substrate. In some embodiments, the system may selectively dividing the image into multiple portions for printing onto smaller substrates, which may be fit together like a puzzle to form the image. During the sizing operation, the line thicknesses may change based on the size of the substrate to which the image is to be printed. Further, the characteristics may include shading, colorations, textures, and other characteristics of the image.

At 1604, the method 1600 may include determining a multi-component mask based on the one or more characteristics. In some examples, it may be possible to adjust both the number of colors and the density of each of the colors (independently) to achieve selected line thicknesses while minimizing the amount of pigment used. Further, in some embodiments, the multi-component mask may be determined based on desired etch depths and other features to be reproduced through etching.

At 1606, the method 1600 may include selectively printing the multi-component mask on a first surface of a substrate. The mask may be printed using a UV printer. The mask may include one or more pigments defining a selected pattern and having a non-uniform pigment density. The pigment density can vary spatially to define a spatially varying thickness of the mask. In an example, the system may selectively adjust the pigment density for one or more pigments from pixel to pixel as the mask is printed.

In some embodiments, the mask can include at least one of spatially distinct pigments, spatially varying pigment combinations, and spatially varying pigment densities that vary across the first surface of the substrate. In an example, the mask may include multiple colors distributed along the substrate and overlapping on the substrate. In another example, the mask may include different combinations of pigments distributed along the substrate. In still another example, the mask can include different pigment densities distributed along the substrate. The compositions of the inks can produce different textures at different color densities for each color and for each combination of colors, when the substrate is exposed to the etch bath. The mask may include at least one of black, cyan, magenta, yellow, and white pigment compositions.

In an example, the mask may be applied by printing the mask onto the substrate using an ultraviolet printer. The selected pattern of the mask includes selected pigments of a plurality of pigments and at selected densities configured to define the selected pattern. The pigment density may be determined based on a selected line thickness and an adhesion quality between the selected pigment and the substrate.

At 1608, the method 1600 may include curing the mask for a predetermined time. Increased cure time may increase the adhesion of the mask to the substrate. The curing process may be in addition to exposure of the ink to UV light.

At 1610, the method 1600 can include applying an etch resistive backing to the substrate. The etch resistive backing may be applied to a second surface of the substrate opposite to the surface on which the mask is printed. In an example, the etch resistive backing may include a vinyl layer, a clear coat, another protective layer, or any combination thereof. In some embodiments, instead of protecting the second surface from etching, a mask may be applied to the second surface to control the etch process.

At 1612, the method 1600 may include selectively etching the substrate. In some embodiments, selectively etching may include determining an etch bath strength (solution strength) and bath duration based on the pigment density, the cure time, and the desired etch depth. In an example, a short cure time may result in the mask being eaten away by the etch bath over a shorter period of time than if the mask had a longer cure time. Further, higher ink densities may allow for a longer etch time without loss of resolution. Other embodiments are also possible. The etch bath may be applied to at least the surface of the substrate that includes the mask. In an example, the substrate is formed from a metal, and the first surface can be etched by applying an etching bath having a selected solution strength for a selected period of time to etch the first surface. The metal can be aluminum, and the etching bath can include a bath of copper sulfate salt. In another example, the etching bath can be a saline solution.

At 1614, the method 1600 may include washing the substrate. The substrate may be washed using a power washer. In some examples, the substrate may be washed using a surfactant or solvent, such as methyl ethyl ketone or another solvent.

At 1616, the method 1600 may include selectively finishing the substrate. In some embodiments, the substrate may be finished using one or more of the methods described above with respect to FIGS. 13A-15. In an example, ink may be applied to the substrate and selectively cured to produce a desired effect. If the ink is to be applied without UV exposure, the system may automatically adjust the image such that the ink coverage is reduced by a few pixels to allow the ink to flow. Subsequent application of thermoplastic and exposure to UV light and heat may cure and seal the ink to the substrate. In some examples, the thermoplastic may bind with and secure the pigment to the substrate. Other embodiments are also possible.

In an example, finishing the substrate can include machine polishing raised surfaces of the substrate to produce a mirror finish. In another example, finishing the substrate can include applying ink directly to the first surface and using ultraviolet light to cure the ink. In another example, finishing the substrate can include machine polishing raised surfaces, selectively applying an ink adhesion promoter to at least a portion of the first surface, and applying paint to the first surface. Additionally, the finishing process can include applying a laminate to the first surface to seal the paint to the first surface.

In another example, finishing the substrate can include selectively applying ink to the first surface while blocking ultraviolet light, selectively applying thermographic plastic to the first surface at selected densities, applying ultraviolet light to the first surface to cure the ink, and heating the substrate to melt the thermoplastic to achieve multiple textures. In another example, finishing the substrate can include covering an ultraviolet light of a printer and selectively applying ink to at least a portion of the first surface using the printer, wherein selectively applying the ink includes shrinking a printing area of a pattern by a few pixels in X and Y dimensions to compensate for spread of uncured ink.

In another example, finishing the substrate can include selectively applying thermographic plastic to at least the portion of the first surface, removing excess thermographic plastic, applying ultraviolet light to the first surface to hold the thermographic plastic in the ink, removing excess thermographic plastic; and heating the substrate to melt the thermal plastic.

Figure 17:
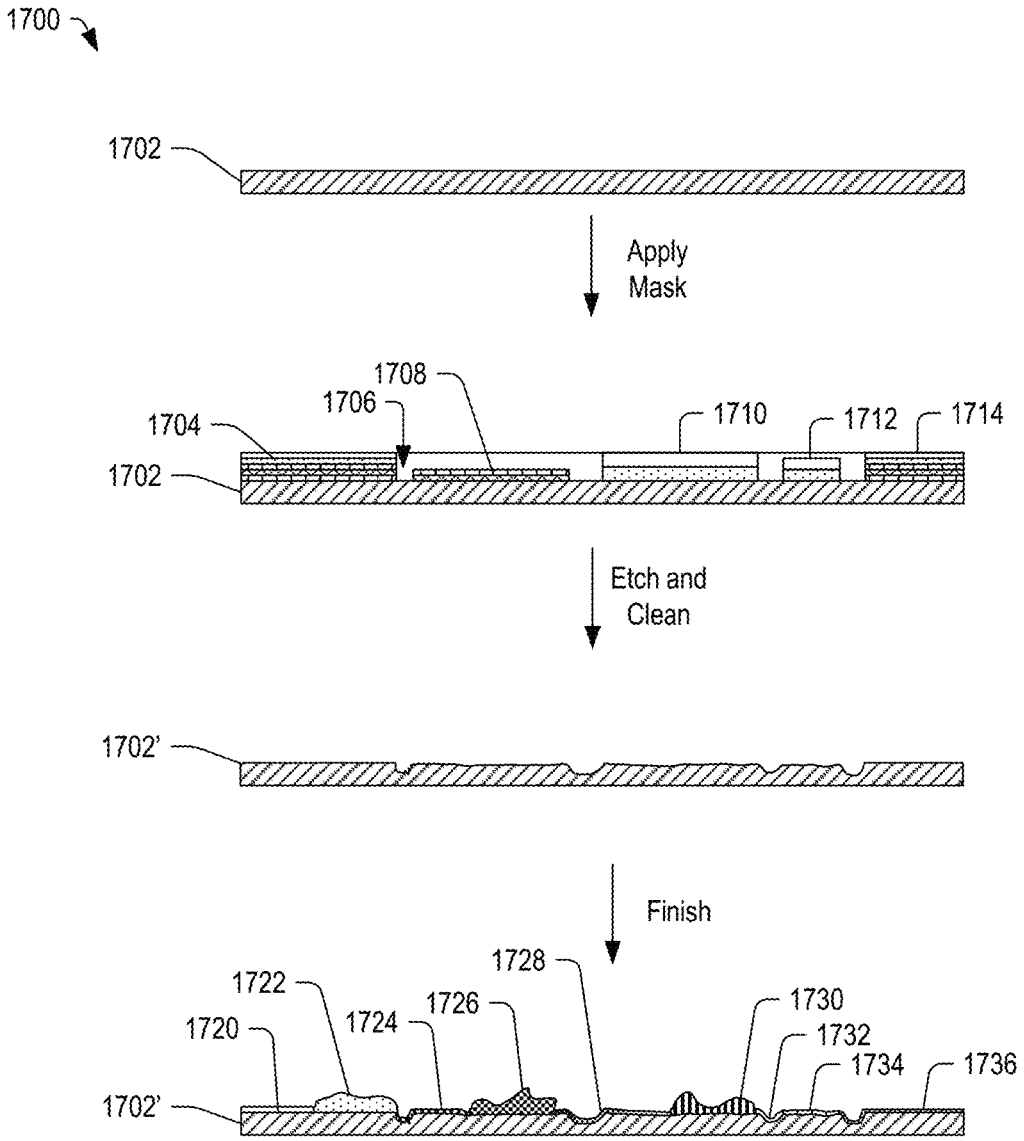
FIG. 17 depicts a process of producing a multi-dimensional visual art work, in accordance with certain embodiments of the present disclosure.

FIG. 17 depicts a process 1700 of producing a multi-dimensional visual art work, in accordance with certain embodiments of the present disclosure. At 1702, a substrate is provided. A mask may be applied to the substrate 1702. The mask may include a first portion 1704 formed from five different pigment compositions, a gap 1706, and a second portion 1708 including two different pigment compositions. The mask may include a third portion 1710 having two different pigment compositions having different densities as compared to the pigments of the pigment compositions 1704 and 1708. The mask may include a fourth portion 1712 and a fifth portion 1714. The mask portions 1704, 1708, 1710, 1712, and 1714 may have different pigment densities and different combinations of pigments.

The substrate 1702 may be exposed to an etching bath and cleaned, resulting in an etched substrate 1702'. Subsequently, ink, thermoplastic, and combinations thereof may be formed on the etched substrate 1702'. In the illustrated example, clear coat 1720 may be applied to first portion. Further, a first pigment 1724, a second pigment 1728, a third pigment 1732, a fourth pigment 1734, and a fifth pigment 1736 may be applied to the substrate 1702'. Additionally, a first pigment/thermoplastic combination 1722 may be applied, a second pigment/thermoplastic combination 1726 may be applied, and a third pigment/thermoplastic combination 1730 may be applied.

In some examples, various combinations of pigments, clear coats, thermoplastic, pigment/thermoplastic compositions, or any combination thereof may be applied to the substrate. Further, pigment densities may be varied to produce desired textures, in addition to the substrate textures.

Figure 18A:
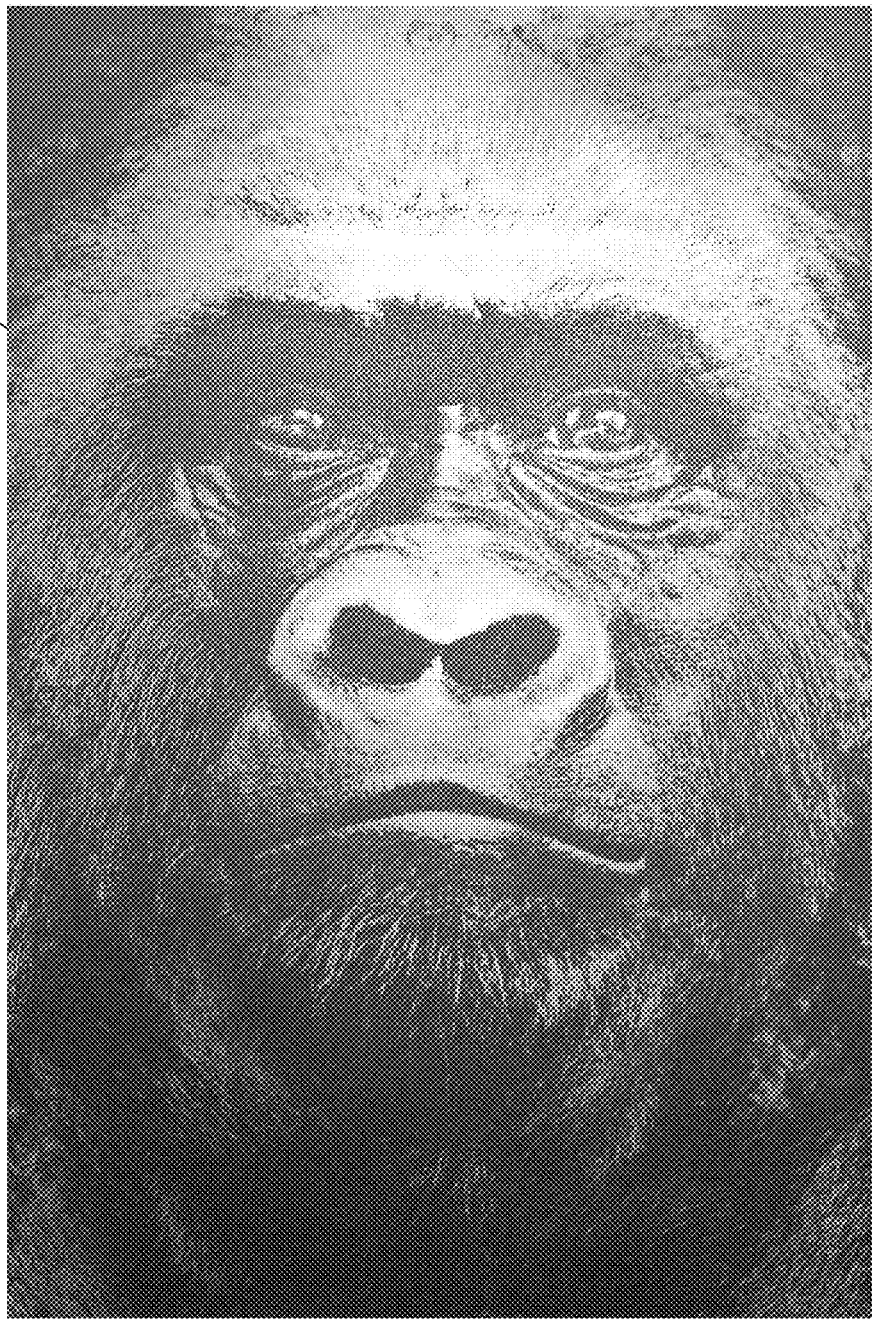
FIG. 18A depicts a picture of a multi-dimensional visual art work depicting a gorilla produced in accordance with certain embodiments of the present disclosure.

FIG. 18A is a picture of a multi-dimensional visual art work 900 produced in accordance with certain embodiments of the present disclosure. The multi-dimensional visual art work 1800 includes a metal substrate 1802. To produce the image, a mask of a gorilla was printed onto a first surface of the metal substrate 1802 and cured. To achieve a desired etch pattern, a mezzotint screen was produced to create a half-tone or a continuous tone mask of multiple pigment layers, and at selected densities. The rear surface of the metal substrate 1802 was coated to prevent etching. The metal substrate 1802 was then exposed to an etching bath having a selected etching solution density and for a selected period of time.

When the period of time elapsed, the etched substrate was removed from the etching bath and the etched substrate 1802 was washed and dried. The substrate 1802 was then buffed and polished. After buffing and polishing, a four-color ink was applied to the etched surface and cured using ultraviolet light. The resulting multi-dimensional visual art work 1800 is shown.

The applied colors reflect light brightly from smooth surfaces, such as the nose and forehead of the gorilla.

However, while the etched surfaces receive a similar pigmentation, the irregularities of the etched surfaces reflect the light differently as compared to the smooth surfaces, producing shadows and shading that may not present in the applied pigment. Moreover, the irregularly etched lines produce a noticeable texture, resulting in a 3D look and feel.

Figure 18B:
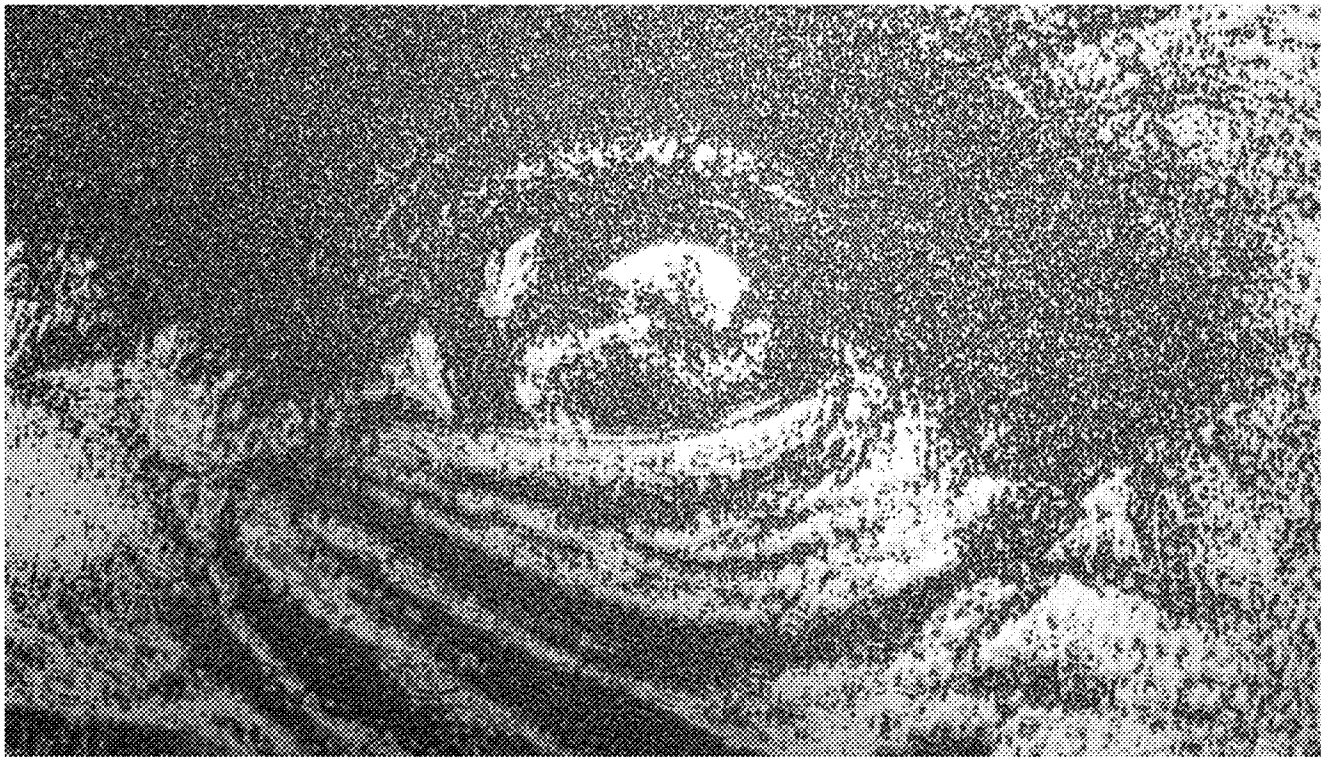
FIG. 18B depicts an expanded view of a portion of the picture of FIG. 18A.

FIG. 18B depicts an expanded view of a portion 1820 of the picture 1800 of FIG. 18A. In particular, the portion 1820 depicts the left eye of the gorilla in the picture 1800. The expanded view shows etched portions, polished portions, and ink deposited over the surface. The etched areas may reflect light differently from the polished areas, producing shading and depth.

In some embodiments, prior to depositing the ink, an adhesion promoter may be applied to the surface. Further, in some embodiments, a lacquer or other sealant may be applied over the textured surface to seal the pigment to the surface. In some embodiments, additional pigments and depth may be added by selectively applying ink to selected portions of the substrate, while blocking ultraviolet light in order to prevent curing. Thermoplastic material may be selectively added to the applied ink, and the substrate may be heated to cause the thermoplastic material to melt and capture the uncured ink. As a result, thermoplastic may produce raised areas of selected pigmentation, producing a further three-dimensional visual and tactile depth. Other embodiments are also possible.

Figure 19:
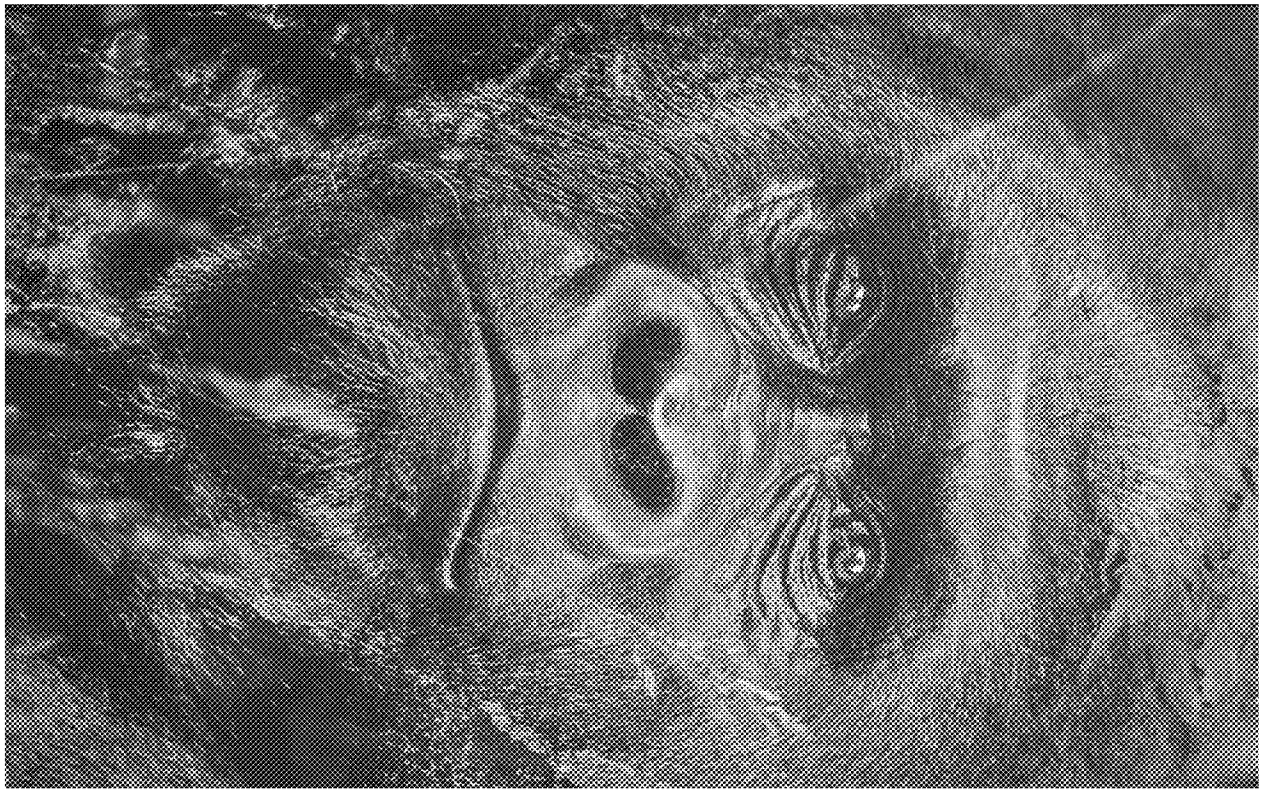
FIG. 19 depicts a picture of a multi-dimensional visual art work of a gorilla produced by a thermographic printing process, in accordance with certain embodiments of the present disclosure.

FIG. 19 depicts a picture of a multi-dimensional visual art work 1900 of the gorilla produced by a thermographic printing process, in accordance with certain embodiments of the present disclosure. In the illustrated example, the multi-dimensional visual art work 1900 may include applying ink to an unetched substrate without exposing the ink to ultraviolet light. Thermoplastic may be applied to the ink. The ink and thermoplastic composition may then be exposed to ultraviolet light to cure the ink and to bond the thermoplastic material to the surface. The substrate may then be heated to melt the thermoplastic. In some embodiments, the density of the ink deposit may influence the texture of the melted thermoplastic, such that a lower density ink deposit area may produce a smoother texture, while thicker ink deposits may produce more texture. After exposing the ink to ultraviolet light and heating the substrate, the resulting substrate may have a three-dimensional texture that lends details, shading, and depth that provides a work of art.

Figure 20:
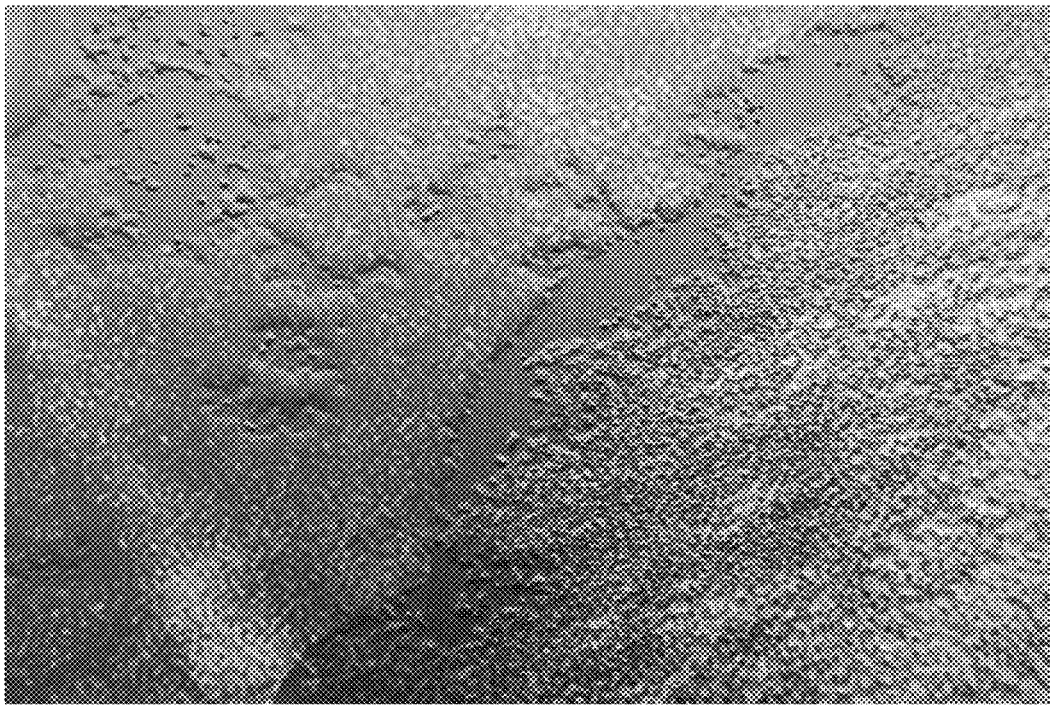
FIG. 20 illustrates a close-up picture of the portion of the multi-dimensional visual art work of FIG. 19 showing variable textures, in accordance with certain embodiments of the present disclosure.

FIG. 20 illustrates a close-up picture 2000 of a portion of the multi-dimensional visual art work of FIG. 19 showing variable textures, in accordance with certain embodiments of the present disclosure. The picture 2000 may include raised textures and smooth textures, which may reflect different ink densities.

Figure 21:
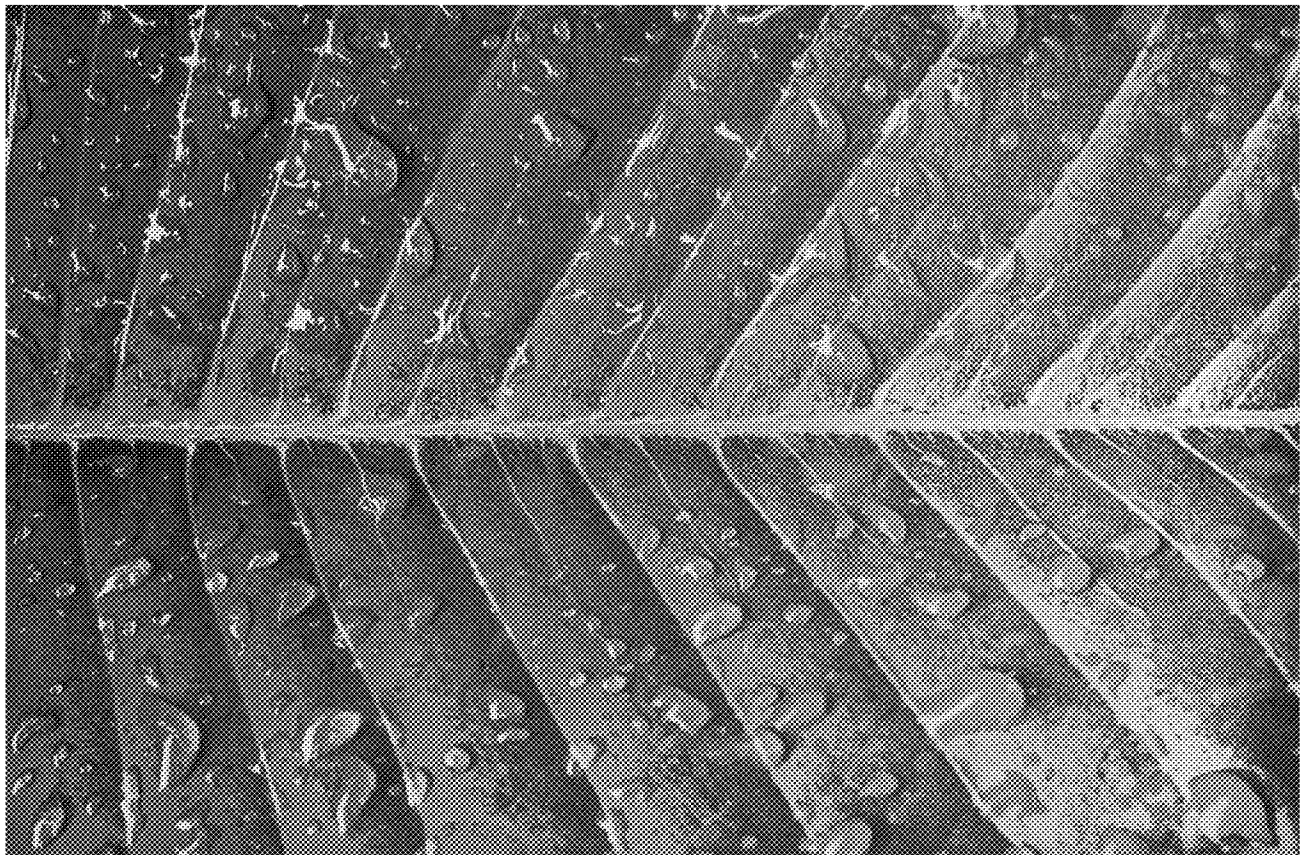
FIG. 21 depicts a picture of a portion of a multi-dimensional visual art work depicting a leaf with water droplets produced using etching, post-etch printing, and thermoplastic, in accordance with certain embodiments of the present disclosure.

FIG. 21 depicts a picture 2100 of a portion of a multi-dimensional visual art work depicting a leaf with water droplets produced using etching, post-etch printing, and thermoplastic, in accordance with certain embodiments of the present disclosure. The picture 2100 may include smooth portions, etched portions, textured portions, and raised portions, which can present the visual appearance and texture of a leaf with water droplets. In the illustrated example, the close-up picture 2200 includes four color inks and white ink on some portions.

Figure 22:
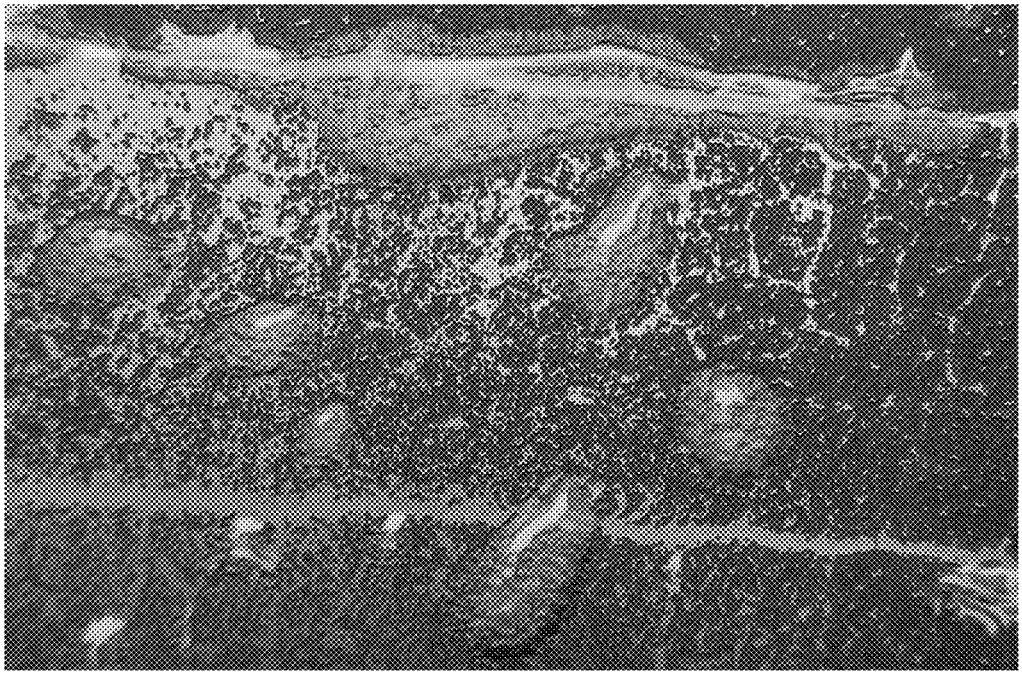
FIG. 22 illustrates a close-up picture of a portion of the multi-dimensional visual art work of FIG. 21 including etch area, ink, and thermoplastic, in accordance with certain embodiments of the present disclosure.

FIG. 22 illustrates a close-up picture 2200 of a portion of the multi-dimensional visual art work of FIG. 21 including etch area, ink, and thermoplastic, in accordance with certain embodiments of the present disclosure. The picture 2200 may include smooth portions, etched portions, textured portions, and raised portions, which can present the visual appearance and texture of a leaf with water droplets. In the illustrated example, the close-up picture 2200 includes four color inks and white ink on some portions.

Figure 23:
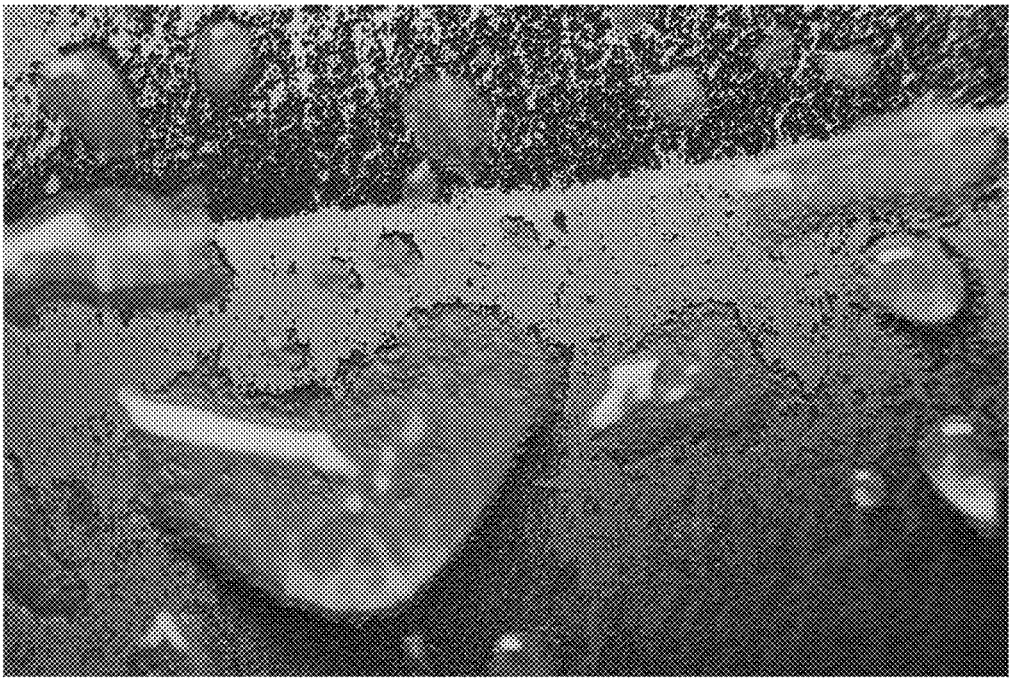
FIG. 23 depicts a close-up picture of a second portion of the multi-dimensional visual art work of FIG. 21 including etch area, ink, and thermoplastic, in accordance with certain embodiments of the present disclosure.

FIG. 23 depicts a close-up picture 2300 of a second portion of the multi-dimensional visual art work of FIG. 21 including etch area, ink, and thermoplastic, in accordance with certain embodiments of the present disclosure. The picture 2300 depicts a portion of the leaf with the textured surface, etched portions, smooth portions of the surface, and a raised element (formed from pigment or clear coat and thermoplastic material). In the illustrated example, the close-up picture 2300 includes four color inks and white ink on some portions.

In conjunction with the systems, methods, and substrates described above with respect to FIGS. 1-23, a substrate may be processed to produce a multi-dimensional visual art work. In an example, a pattern may be painted onto a surface of the substrate, and the substrate may be etched according to the pattern. Subsequently, the etched substrate may be further processed to produce a desired aesthetic effect. Such processing can include applying ink and curing the ink; machine polishing; machine polishing, applying ink, and curing the ink; applying ink without curing, applying thermoplastic, and heating the thermoplastic to secure the uncured ink; or any combination thereof. In some embodiments, a sealant may be applied to the finished surface to protect the surface from contact or wear. Other embodiments are also possible.

Although the present invention has been described with reference to preferred embodiments, workers skilled in the art will recognize that changes may be made in form and detail without departing from the scope of the invention.

What is claimed is:

1. A method comprises:

selectively printing a selected pattern onto a first surface of a substrate in a single printing operation using a printer, the selected pattern including one or more pigments having a non-uniform density, the non-uniform density being formed by printing at least one pigment at a first pigment density at a first portion of the selected pattern and printing at least one of the first pigment and a second pigment of the one or more pigments at a second pigment density at a second portion of the selected pattern such that the selected pattern includes a spatially varying pigment density;

exposing the selected pattern to ultraviolet light to cure the one or more pigments to form the mask having a spatially variable thickness based on the non-uniform density;

etching the first surface of the substrate to produce an etched surface based on the mask, the etched surface having a first etch depth in first areas of the first surface having no pigment, having a second etch depth beneath the first portion of the selected pattern, and having a third etch depth beneath the second portion of the selected pattern; and selectively processing the etched surface of the substrate to produce a multi-dimensional artwork.

2. The method of claim 1, wherein the one or more pigments includes at least two pigment compositions.

3. The method claim 2, wherein the at least two pigment compositions includes at least two of a black pigment, a cyan pigment, a magenta pigment, a yellow pigment, and a white pigment.

4. The method of claim 1, wherein the selected pattern includes selected pigments and pigment combinations of a plurality of pigments at selected densities defining the selected pattern.

5. The method of claim 1, further comprising determining a pigment density based on at least one of a selected line thickness and a selected etch determined from an image.

6. The method of claim 1, wherein:

the substrate comprises a metal; and etching the first surface includes exposing the mask and the substrate to an etching bath having a selected solution strength for a selected period of time.

7. The method of claim 6, wherein:

the metal includes aluminum; and the etching bath comprises a bath of copper sulfate salt.

8. The method of claim 6, wherein the etching bath comprises a saline solution.

9. The method of claim 1, wherein selectively processing the etched surface comprises machine polishing selected surfaces of the substrate to produce a mirror finish.

10. The method of claim 1, wherein selectively processing the etched surface comprises:

applying an ink directly to the etched surface; and using ultraviolet light to cure the ink.

11. The method of claim 1, wherein selectively processing the etched surface comprises:

machine polishing selected surfaces;

selectively applying an ink adhesion promoter to at least a portion of the etched surface; and applying an ink to the etched surface, the ink including at least one pigment.

12. The method of claim 11, further comprising applying a protective coating to the etched surface to seal the ink to the etched surface.

13. The method claim 1, wherein selectively processing the etched surface comprises:

selectively applying an ink to the etched surface while selectively preventing exposure to ultraviolet light;

selectively applying thermographic material to the etched surface at selected densities;

removing excess thermographic material;

applying ultraviolet light to the first surface to cure the ink; and heating the substrate to melt the thermoplastic material to achieve multiple textures.

14. The method of claim 1, wherein selectively processing the etched surface comprises:

covering an ultraviolet light of a printer; and selectively applying ink to at least a portion of the etched surface using the printer; and wherein selectively applying the ink includes shrinking a printing area of a pattern by a few pixels in X and Y dimensions to compensate for spread of uncured ink.

15. A method comprising:

selectively printing a selected pattern onto a first surface of a substrate, the pattern including at least two of a plurality of pigment components and including a non-uniform density formed by printing one of the at least two of the plurality of pigments with a first density at a first portion of the selected pattern and at a second density at a second portion of the selected pattern, wherein the first density and a second density are greater than zero;

exposing the selected pattern to ultraviolet light to form a mask having a spatially variable thickness based on the non-uniform density;

selectively exposing the mask and the first surface of the substrate to an etching solution to produce an etched surface, the etched surface having a first etch depth in first areas of the first surface having no pigment, having a second etch depth beneath the first portion of the selected pattern, and having a third etch depth beneath the second portion of the selected pattern; and selectively processing the etched surface to produce a multi-dimensional workpiece.

16. The method of claim 15, wherein selectively processing the etched surface comprises:

machine polishing at least a portion of the etched surface; and selectively applying at least one of an ink and a thermographic plastic to the etched surface.

17. The method of claim 16, further comprising:

exposing the etched surface to ultraviolet light to cure the ink; and selectively heating the substrate when thermographic plastic is applied to the etched surface.

* * * * *